US007880705B2

(12) United States Patent
Shiomi

(10) Patent No.: US 7,880,705 B2
(45) Date of Patent: Feb. 1, 2011

(54) DRIVER DEVICE FOR LIQUID CRYSTAL DISPLAY, COMPUTER PROGRAM AND STORAGE MEDIUM, AND LIQUID CRYSTAL DISPLAY

(75) Inventor: Makoto Shiomi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 1188 days.

(21) Appl. No.: 11/183,994

(22) Filed: Jul. 19, 2005

(65) Prior Publication Data

US 2006/0017678 A1 Jan. 26, 2006

(30) Foreign Application Priority Data

Jul. 20, 2004 (JP) ..... 2004-212186
Apr. 8, 2005 (JP) ..... 2005-112891

(51) Int. Cl.
*G09G 3/36* (2006.01)

(52) U.S. Cl. ..... 345/89

(58) Field of Classification Search ..... 345/89, 345/690

See application file for complete search history.

(56) References Cited

U.S. PATENT DOCUMENTS

| | | | | |
|---|---|---|---|---|
| 5,034,986 | A | 7/1991 | Karmann et al. | |
| 5,465,102 | A * | 11/1995 | Usui et al. | 345/89 |
| 6,496,194 | B1 | 12/2002 | Mikoshiba et al. | |
| 6,661,488 | B1 | 12/2003 | Takeda et al. | |
| 7,113,227 | B1 * | 9/2006 | Kakuya et al. | 348/678 |
| 2001/0033691 | A1 * | 10/2001 | Kimura | 382/199 |
| 2002/0021395 | A1 | 2/2002 | Koma et al. | |
| 2002/0036717 | A1 * | 3/2002 | Abiko et al. | 348/700 |
| 2002/0140658 | A1 | 10/2002 | Takatori | |
| 2003/0142055 | A1 * | 7/2003 | Iisaka | 345/89 |
| 2004/0183820 | A1 * | 9/2004 | Kawahara et al. | 345/690 |
| 2004/0263495 | A1 * | 12/2004 | Sugino et al. | 345/204 |
| 2005/0024546 | A1 * | 2/2005 | Kubo et al. | 349/33 |
| 2005/0162360 | A1 * | 7/2005 | Ishihara et al. | 345/89 |

FOREIGN PATENT DOCUMENTS

| | | |
|---|---|---|
| EP | 0 662 767 A2 | 12/1995 |
| JP | 11-109391 | 4/1999 |
| JP | 11-258605 | 9/1999 |
| TW | 548477 | 8/2003 |
| TW | 550412 | 9/2003 |

* cited by examiner

*Primary Examiner*—Chanh Nguyen
*Assistant Examiner*—Robert M Stone
(74) *Attorney, Agent, or Firm*—Harness, Dickey & Pierce, P.L.C.

(57) ABSTRACT

There is provided a motion-adaptive grayscale level converter section between a video signal source and a pixel array. The pixel array includes a liquid crystal cell of normally black and vertically aligned mode. The motion-adaptive grayscale level converter section determines based on information from a decoder section whether the pixels of an image represented by a video signal is in a moving image area. If a pixel is in a moving image area, the motion-adaptive grayscale level converter section changes the grayscale level data representing the grayscale level of the pixel so that there is no darker grayscale level than a predetermined first grayscale level. The resultant data is output as a video signal. Accordingly, we can provide a liquid crystal display capable of easing image quality degradation due to insufficient response when displaying a moving image while maintaining the contrast ratio achieved for a still image display.

13 Claims, 16 Drawing Sheets

| | | FINISHING GRAYSCALE LEVELS | | | | | | | | |
|---|---|---|---|---|---|---|---|---|---|---|
| | | 0 | 32 | 64 | 96 | 128 | 160 | 192 | 224 | 255 |
| STARTING GRAYSCALE LEVELS | 0 | — | 59.0 | 38.8 | 29.4 | 24.4 | 16.0 | 14.0 | 14.2 | 15.2 |
| | 32 | 4.8 | — | 27.6 | 22.6 | 18.6 | 17.0 | 16.2 | 11.8 | 2.0 |
| | 64 | 4.2 | 23.2 | — | 20.4 | 18.4 | 17.4 | 16.6 | 6.4 | 1.8 |
| | 96 | 4.0 | 18.8 | 18.8 | — | 18.0 | 17.4 | 16.8 | 5.4 | 1.8 |
| | 128 | 3.8 | 16.2 | 17.8 | 17.6 | — | 17.4 | 16.6 | 4.8 | 1.8 |
| | 160 | 3.8 | 13.6 | 17.0 | 17.4 | 17.4 | — | 16.6 | 4.2 | 1.8 |
| | 192 | 4.0 | 12.0 | 15.8 | 17.0 | 17.0 | 16.2 | — | 3.8 | 1.8 |
| | 224 | 4.2 | 10.8 | 14.8 | 16.8 | 17.0 | 16.6 | 9.4 | — | 1.6 |
| | 255 | 4.4 | 10.4 | 14.0 | 16.6 | 16.8 | 16.8 | 7.8 | 3.4 | — |

DRIVER DEVICE FOR LIQUID CRYSTAL DISPLAY, COMPUTER PROGRAM AND STORAGE MEDIUM, AND LIQUID CRYSTAL DISPLAY

This Nonprovisional application claims priority under 35 U.S.C. §119(a) on patent applications Ser. No. 2004-212186 filed in Japan on Jul. 20, 2004 and No. 2005-112891 filed in Japan on Apr. 8, 2005, the entire contents of which are hereby incorporated by reference.

FIELD OF THE INVENTION

The present invention relates to driver devices for liquid crystal displays which are capable of limiting image quality degradation due to insufficient response when displaying a moving image while maintaining a contrast ratio achieved for a still image display. The invention also relates to associated computer programs and storage media, as well as associated liquid crystal displays.

BACKGROUND OF THE INVENTION

Liquid crystal displays operating on relatively low electric power have found a wide range of applications as image displays for fixed types of devices, as well as for mobiles. Some of these liquid crystal displays include liquid crystal cells of vertically aligned mode and normally black mode as a display element for improved viewing angle characteristics and contrast ratio.

Examples are disclosed in Japanese published patent application 11-109391/ 1999 (Tokukaihei 11-109391; published on Apr. 23, 1999) and Japanese published patent application 11-258605/1999 (Tokukaihei 11-258605; published on Sep. 24, 1999) which will be detailed later. Each liquid crystal display is of vertically aligned mode and contains a vertically aligned film and a liquid crystal with negative dielectric anisotropy. In the absence of applied voltage, liquid crystal molecules align vertically. Linearly polarized light incident from a polarizer on a liquid crystal layer under these conditions leaves the liquid crystal layer while retaining its polarization, because the liquid crystal layer has little birefringence (optical anisotropy). The light is then absorbed by a polarizer positioned on the opposite side of the liquid crystal layer. The liquid crystal display thus achieves a black display.

In contrast, when a voltage is applied, liquid crystal molecules in the liquid crystal layer tilt in accordance with the applied voltage. Linearly polarized light incident from a polarizer on a liquid crystal layer under these conditions develops phase difference in the liquid crystal layer. The light thus changes its polarization. Therefore, the light, upon leaving the liquid crystal cell, typically becomes elliptically polarized.

The elliptically polarized light then hits another polarizer located on the light-emitting side of the liquid crystal cell. The elliptically polarized light only partially passes through the polarizer, which is different from the event in the absence of applied voltage; the amount of light that is transmitted depends on the phase difference provided by the liquid crystal layer. Thus, the amount of light leaving the liquid crystal display can be altered by adjusting the alignment direction of the liquid crystal molecules through the control of the applied voltage to the liquid crystal layer. The altering of the amount of light enables a grayscale display.

However, liquid crystal displays which include as a display element a liquid crystal cell of vertically aligned mode and normally black mode can suffer motion blurriness and other display quality degradation when displaying moving images. Further display quality improvements are needed.

SUMMARY OF THE INVENTION

The present invention is a result of the study of characteristics of liquid crystal displays with a liquid crystal cell of vertically aligned mode and normally black mode as a display element. The invention has an objective to provided a driver device for liquid crystal displays which is capable of limiting image quality degradation due to insufficient response when displaying a moving image while maintaining a contrast ratio achieved for a still image display. The invention also has an objective to provide an associated computer program and storage medium, as well as an associated liquid crystal display.

The driver device for a liquid crystal display in accordance with an aspect of the present invention, to achieve the objective, is a driver device for a liquid crystal display including a liquid crystal cell of normally black and vertically aligned mode as a display element. The device includes: determine means for determining whether a pixel is in a moving image area; and grayscale level conversion means for, if the pixel is determined to be in the moving image area, changing grayscale level data representing a grayscale level of the pixel so that there is no darker grayscale level than a predetermined first grayscale level. The driver device for the liquid crystal display may be configured by hardware or by a computer running a computer program.

In a liquid crystal cell of vertically aligned mode, liquid crystal molecules align substantially vertically to a substrate in the absence of applied voltage. In such a liquid crystal cell, voltage is applied to pixel electrodes to generate an electric field oblique to the substrate surface. The electric field causes the tilting of the liquid crystal molecules.

When the liquid crystal molecules substantially vertically align, however, the alignment orientation (in-plane component of the alignment direction as projected on the substrate) is yet to be definite. When the liquid crystal molecules which is to tilt from this state, both the alignment orientation and the tilt angle (angle between the normal to the substrate and the alignment direction) become definite once the applied voltage increases. In contrast, those liquid crystal molecules of which the alignment orientation is already definite do not need to determine alignment orientation. They only have to determine the tilt angle in accordance with apply voltage.

Therefore, the liquid crystal cell tends to show a far slower response speed when the grayscale level is changed from a grayscale level near black (a state where there are still many liquid crystal molecules of which the alignment orientation is yet to be definite in the pixel) than when the grayscale level is changed from a middle level (a state where almost all the liquid crystal molecules in the pixel only need to decide the tilt angle).

In these circumstances, if the voltage applied to the pixel is always increased when displaying black so as to prevent the occurrence of a state where there are still many liquid crystal molecules of which the alignment orientation is yet to be definite, the contrast ratio decreases even in a case where no quick response speed is needed, like in a case where a still image is displayed.

In contrast, according to the arrangement, for example, the determine means determines whether the pixel is in a moving image area on the basis of an input video signal or information from a member processing the input video signal. If the pixel is determined to be in a moving image area, the grayscale level conversion means changes the grayscale level data representing the grayscale level of the pixel so that there is no darker grayscale level than the first grayscale level. Therefore, image quality degradation due to insufficient response when displaying a moving image can be eased while maintaining the contrast ratio achieved for a still image display. The member may be a decoder section, a resolution converter section, or a video filter section.

In addition to the arrangement, the determine means may determine whether or not the pixel is in the moving image area according to whether or not an intermediate region including the pixel evenly contains more than a threshold number of minimal regions of a moving image. The intermediate region is made up of multiple minimal regions, video in each frame being divided into the minimal regions.

If the determination as to a moving image is made for every minimal movie region and if a grayscale level conversion is done for every minimal movie region, minimal regions with different contrasts are displayed tangled. Block separation (block-like uneven luminance) may possibly become visible, which could cerate an unnatural video display. In addition, regarding relatively still areas like the background around a moving area of a moving image observation object, insufficient response cannot be improved when the minimal regions included in the area are dark.

In contrast, according to the arrangement, the intermediate region are made up of multiple minimal regions, and it is decided whether the pixel is in the moving image area according to whether or not an intermediate region including the pixel evenly contains more than a threshold number of minimal regions of a moving image.

Therefore, the grayscale level conversion can be done on the moving areas of a moving image observation object and the background around its periphery too. This limits occurrence of insufficient response in an area with the slowest response with more natural grayscale level display. In addition, even when the minimal regions in the background area are displayed dark, insufficient response is addressed.

The driver device for a liquid crystal display in accordance with another aspect of the present invention, to achieve the objective, is a driver device for a liquid crystal display including a liquid crystal cell of normally black and vertically aligned mode as a display element. The device, if an image includes a moving image area, changes a signal value for a pixel, in the moving image area, which is instructed to produce a display at a darker grayscale level than a predetermined first grayscale level to a value instructing a brighter grayscale display than in a case where a part of the image which is in the moving image area is displayed as a still image.

According to the arrangement, the signal value for the pixel, in the moving image area, which is instructed to produce a display at a darker: grayscale level than a predetermined first grayscale level is changed to a value instructing a brighter grayscale display than in a case when displayed as a still image. Therefore, image quality degradation due to insufficient response when displaying a moving image is eased while maintaining the contrast ratio achieved for a still image display although a liquid crystal cell of normally black and vertically aligned mode having the following properties, in other words, a liquid crystal cell of normally black and vertically aligned mode which tends to have improved viewing angle characteristics and contrast ratio, but which tends to show far slower response speed when the grayscale level is changed from a near-black grayscale level, is used as a display element.

Additional objects, advantages and novel features of the invention will be set forth in part in the description which follows, and in part will become apparent to those skilled in the art upon examination of the following or may be learned by practice of the invention.

DESCRIPTION OF THE EMBODIMENTS

Embodiment 1

The following will describe an embodiment of the present invention in reference to FIG. 1 through FIG. 13. The image display in accordance with the present embodiment is built around a display element which is a liquid crystal cell of vertically aligned mode and normally black mode. The display is capable of preventing both motion blurriness and other display quality degradation of moving images and poor contrast ratio of still images. The display is suitable for use in television sets and computer monitors among other examples. The television set may receive broadcasts from terrestrial broadcasting, satellites, such as a digital BS (broadcast satellite) and a digital CS (communications satellite), and a cable, for example.

Figure 1:
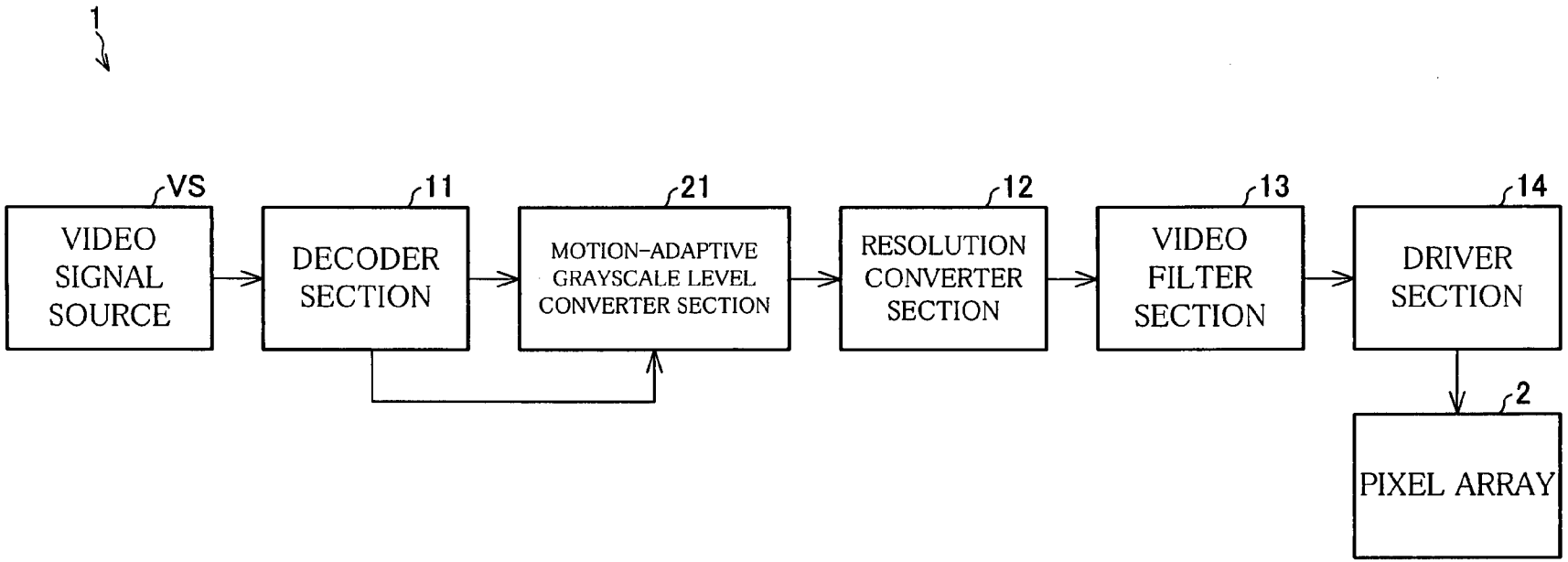
FIG. 1, depicting an embodiment of the present invention, is a block diagram illustrating a structure of primary components of an image display.

Referring to FIG. 1, an image display 1 in accordance with the present embodiment displays an image derived from a video signal representing a compressed image on a pixel array 2. The signal is fed from a video signal source VS. The display 1 contains the pixel array 2, a decoder section 11, a resolution converter section 12, a video filter section 13, a driver section 14, and a motion-adaptive grayscale level converter section 21. The decoder section 11 decodes a video signal DAT1 from the video signal source VS to generate a video signal DAT2 in bitmap format. The resolution converter section 12 changes the resolution of the decoded video signal DAT2 to match the resolution of the pixel array 2. The resultant video signal DAT2 then undergoes video filtering in the video filter section 13. After the video filtering, the driver section 14 drives the pixels in the pixel array 2 according to the video signal DAT2 (or now referenced as DAT3). The motion-adaptive grayscale level converter section 21 is provided between the decoder section 11 and the resolution converter section 12 and converts grayscale level data for pixels in accordance with whether the pixels are in a moving image area. The pixel array 2 is an equivalent to the display element recited in claims. The motion-adaptive grayscale level converter section 21 is an equivalent to the driver device recited in claims which includes determine means and grayscale level conversion means.

Before describing the structure and operation of the motion-adaptive grayscale level converter section 21 in detail, the following will describe the structure and operation of other members. For convenience, reference numbers will bear an alphanumerical suffix indicating the member's position only when the position needs to be clearly identified (e.g., i-th data signal line SLi). When the position does not need to be identified or the members are collectively referenced, the position-indicating suffix is omitted.

The pixel array 2 in accordance with the present embodiment includes a liquid crystal cell of vertically aligned mode. Specifically, the liquid crystal molecules align substantially vertical to the substrate in the absence of applied voltage and tilt from the vertically aligned state in accordance with the voltage applied across the liquid crystal capacitance CL of the pixels. The driver section 14 in accordance with the present embodiment uses the liquid crystal cell in normally black mode (appears black in the absence of applied voltage).

Figure 2:
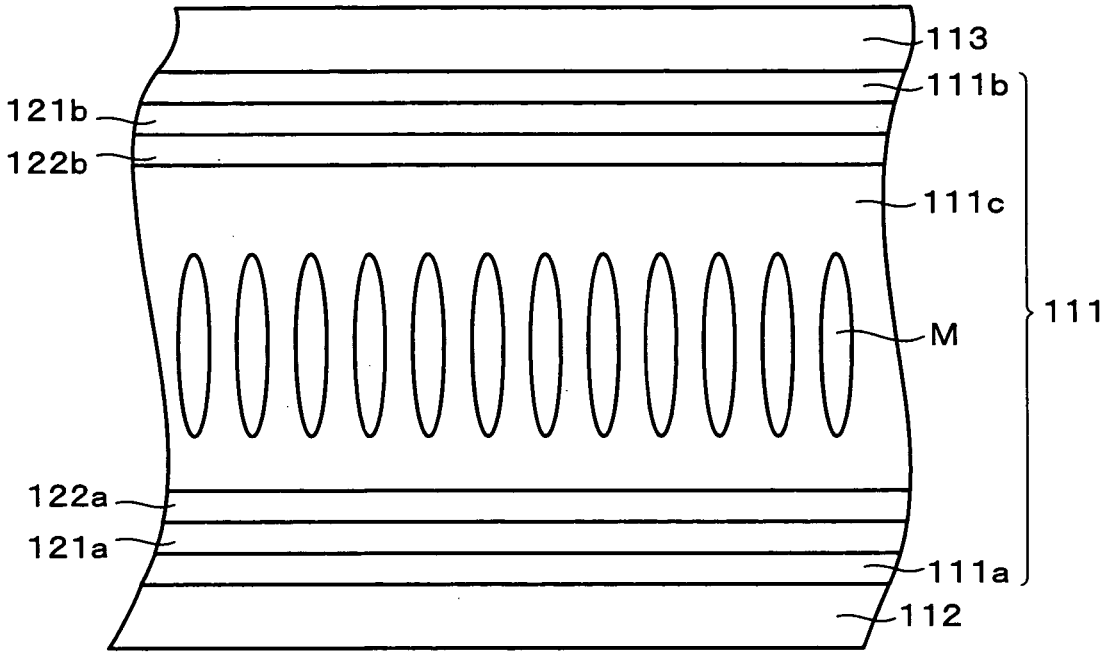
FIG. 2, depicting a liquid crystal cell provided in the image display, is a schematic drawing of a no-voltage-applied state.

To describe it in more detail, the pixel array 2 in accordance with the present embodiment includes a liquid crystal cell (liquid crystal display) 111 of vertically aligned (VA) mode and polarizers 112, 113 provided on two sides of the liquid crystal cell 111 as shown in FIG. 2.

The liquid crystal cell 111 includes a TFT (Thin Film Transistor) substrate 111*a*, an opposite substrate 111*b*, and a liquid crystal layer 111*c*. The TFT substrate 111*a* has pixel electrodes 121*a* each for a different pixel. The opposite substrate 111*b* has an opposite electrode 121*b*. The liquid crystal layer 111*c* contains nematic liquid crystal having negative dielectric anisotropy and is sandwiched between the substrates 111*a*, 111*b*. The image display 1 in accordance with the present embodiment is capable of color displays. The opposite substrate 111*b* has color filters (not shown) corresponding to the colors of the pixels.

The TFT substrate 111*a* has a vertically aligned film 122*a* on its surface facing the liquid crystal layer 111*c*. Likewise, the opposite substrate 111*b* has a vertically aligned film 122*b* on its surface facing the liquid crystal layer 111*c*. Because of the provision of the films 122*a*, 122*b*, the liquid crystal molecules M in the liquid crystal layer 111*c* sandwiched between the substrates 111*a*, 111*b* align substantially vertical to the surfaces of the substrates 111*a*, 111*b* when there is no applied voltage across the electrodes 121*a*, 121*b* (no-voltage-applied state).

Figure 3:
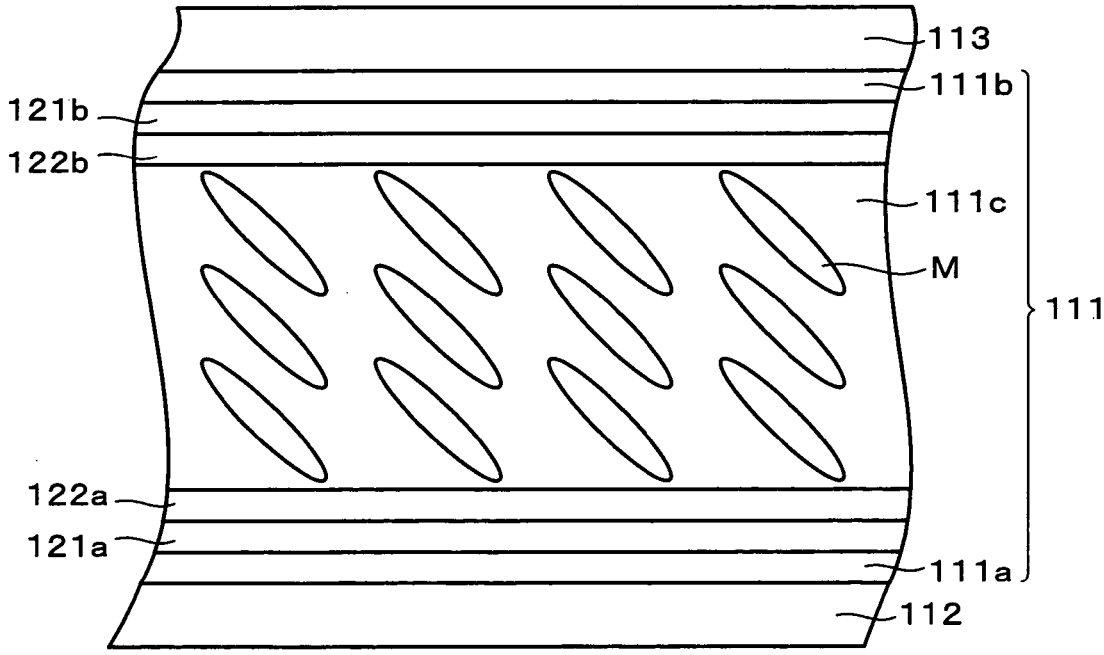
FIG. 3, depicting a liquid crystal cell provided in the image display, is a schematic drawing of a voltage-applied state.

In contrast, when a voltage is applied across the electrodes 121*a*, 121*b*, the liquid crystal molecules M tilt off the normal to the substrates 111*a*, 111*b* by a tilt angle in accordance with the applied voltage (see FIG. 3). No distinction will be made between the normal and in-plane directions of the substrate 111*a* and those of the substrate 111*b*, because the substrates 111*a*, 111*b* are located opposing each other.

The liquid crystal cell 111 in accordance with the present embodiment is a liquid crystal cell of a multidomain alignment. Each pixel is divided into multiple domains. The alignment direction of the liquid crystal molecules M under applied voltage is controlled so that the in-plane component differs from domain to domain.

Figure 4:
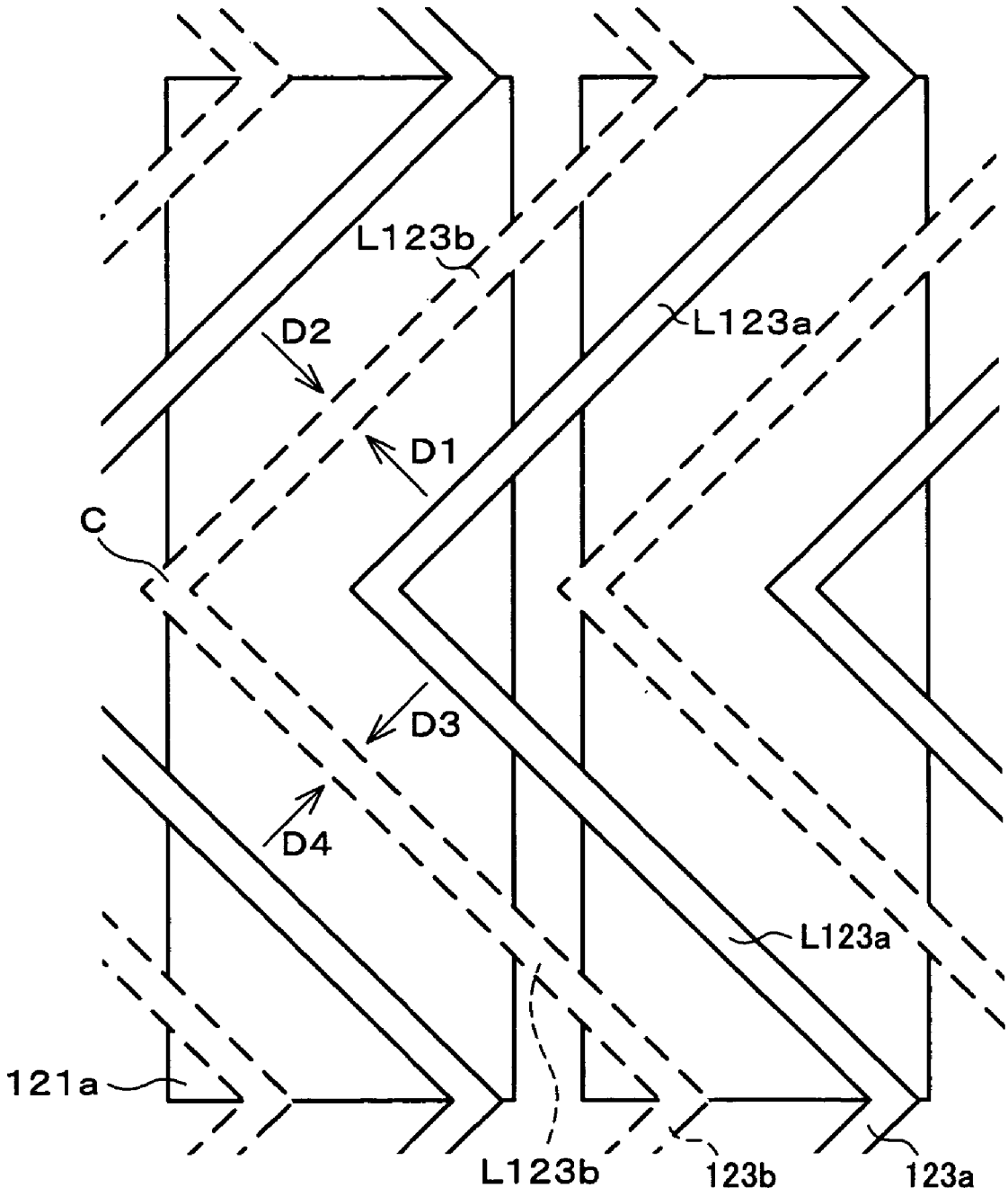
FIG. 4, depicting a structural example of the liquid crystal cell, is a plan view illustrating pixel electrodes and their vicinity.
Figure 5:
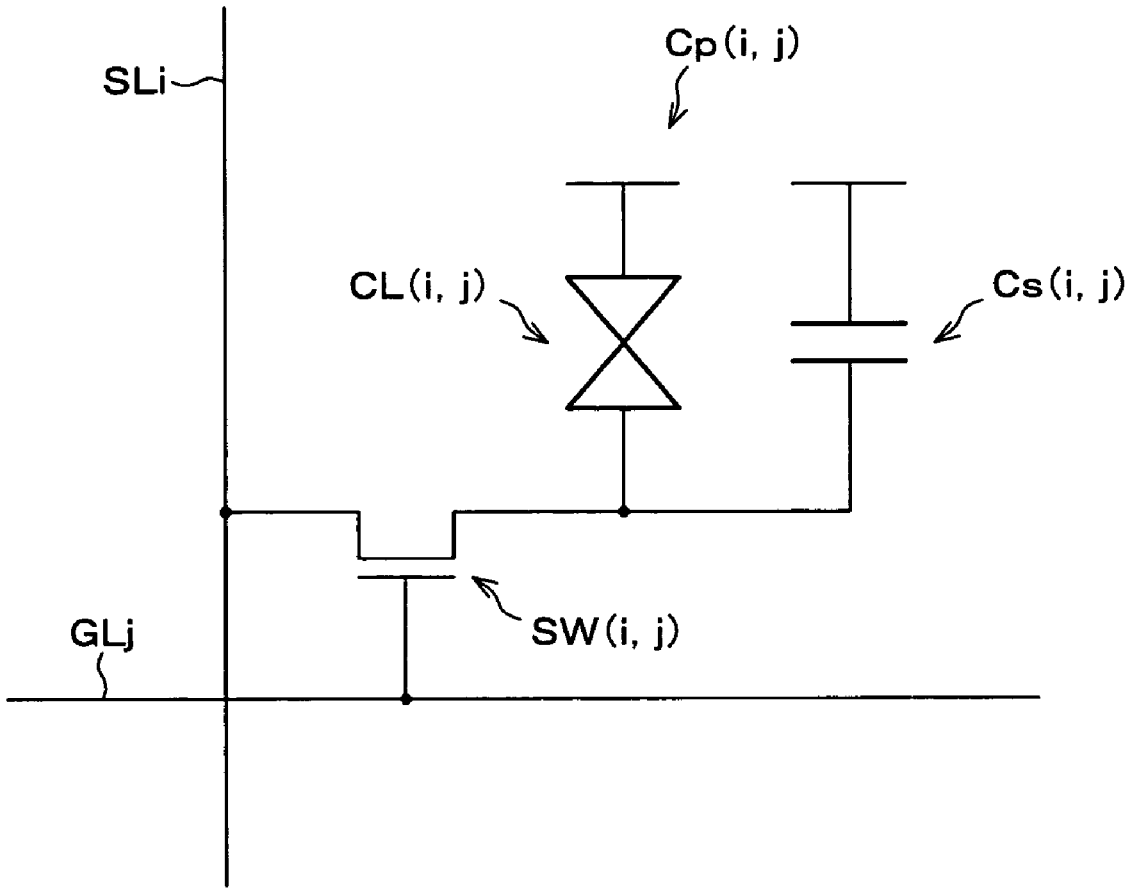
FIG. 5 is a circuit diagram depicting a structural example of a pixel in the image display.

Specifically, as shown in FIG. 4, the pixel electrodes 121*a* have zigzag ridges 123*a* extending parallel to each other on the surface. The ridges 123*a* turn at almost 90° at the corners. Each ridge 123*a* is convex in cross section. The opposite electrode 121*b* has zigzag slits 123*b* extending parallel to each other on the surface. The slits turn at almost 90° at the corners. The "slit" here refers to an opening in the opposite electrode. The distance between adjacent ridges 123*a* is predetermined. So is the distance between adjacent slits 123*b*. The ridges 123*a* are made by applying a photosensitive resin onto the pixel electrodes 121*a* which is then processed by photolithography. The electrodes 121*a*, 121*b* are made by providing ITO (indium tin oxide) films on the substrates 111*a*, 111*b* and then a photoresist on the ITO films to form electrode patterns which is then exposed to light, developed, and etched. The slits 123*b* made by patterning the opposite electrode 121*b* so that no electrode forms at locations which will be the slits 121*b*.

In the vicinity of the ridges 123*a*, the liquid crystal molecules align vertical to the slopes of the ridges 123*a*. Further, the electric field derived from applied voltage inclines parallel to the slopes of the ridges 123*a* in the vicinity of the ridges 123*a*. The liquid crystal molecules turn so that their long axes are vertical to the electric field, which means that the liquid crystal molecules align oblique to the substrate surfaces. Away from the slopes of the ridges 123*a*, the liquid crystal molecules align similarly to those in the vicinity of the slopes, because of the continuum of the liquid crystal.

Likewise, the electric field derived from applied voltage inclines with respect to the substrate surface in the vicinity of the edges of the slits 123*b* (borders of the slits 123*b* and the opposite electrode 121*b*). The liquid crystal molecules align oblique to the substrate surface. Away from the edges, the liquid crystal molecules align similarly to those in the vicinity of the edges, because of the continuum of the liquid crystal.

Therefore, in the portion between a linear stretch L123*a* of the ridges 123*a* and a linear stretch L123*b* of the slits 123*b*, the in-plane component of the alignment direction of the liquid crystal molecules under applied voltage matches the in-plane component of the direction from the linear stretch L123*a* to the linear stretch L123*b* (perpendicular to the middle line of the linear stretches L123*a*, L123*b*). A linear stretch is that part of the ridges 123*a* and the slits 123*b* which connects adjacent corners C.

The ridges 123*a* and the slits 123*b* turn at almost 90° at the corners C. Therefore, the liquid crystal molecules align in four directions in each pixel. This creates domains D1 to D4 of different alignment directions of liquid crystal molecules.

The two polarizers 112, 113 in FIG. 2 are disposed so that the absorption axis AA112 of the polarizer 112 is orthogonal to the absorption axis AA113 of the polarizer 113. The polarizers 112, 113 are disposed also so that under applied voltage, the absorption axes AA112, AA113 are at an angle of 45° to the in-plane components of the alignment directions of the liquid crystal molecules in the domains D1 to D4.

Now, refer to FIG. 3. In the pixel array 2 constructed as above, when voltage is applied across the pixel electrodes 121*a* and the opposite electrode 121*b*, the liquid crystal molecules in the liquid crystal cell 111 align tilting off the normal to the substrate by an angle in accordance with the voltage. Accordingly, the light passing through the liquid crystal cell 111 develops phase difference in accordance with the voltage.

The polarizers 112, 113 are disposed so that the absorption axes AA112, AA113 are at right angles to each other. Therefore, the light incident on a polarizer after passing through the liquid crystal cell 111 (e.g., the polarizer 112) becomes elliptically polarized in accordance with the phase difference provided by the liquid crystal cell 111. That incident light partially passes through the polarizer 112. Hence, the amount of outgoing light from the polarizer 112 is controllable through the applied voltage, thereby realizing grayscale displays.

In each pixel in the liquid crystal cell 111, there are formed domains D1 to D4 of different alignment directions of liquid crystal molecules. Therefore, when one looks at the liquid crystal cell 111 from a direction parallel to the alignment direction of the liquid crystal molecules in one of the domains (e.g., D1), these liquid crystal molecules do not cause phase difference in the transmitted light, but those in the other domains (e.g., D2 to D4) causes phase difference in the transmitted light. The domains thus work in an optically complementary manner. The liquid crystal cell 111 hence has improved display quality when viewed from oblique directions and offers increased viewing angles.

In contrast, referring back to FIG. 2, when there is no voltage applied across the pixel electrodes 121*a* and the opposite electrode 121*b*, the liquid crystal molecules in the liquid crystal cell 111 are vertically aligned. Under these conditions (i.e., in the absence of applied voltage), the liquid crystal molecules cause no phase difference in the light hitting the liquid crystal cell 111 at right angles. The light passes through the liquid crystal cell 111 while retaining its polarization. Therefore, the light incident on a polarizer after passing through the liquid crystal cell 111 (e.g., the polarizer 112) becomes polarized linearly, substantially parallel to the absorption axis AA112 of the polarizer 112. The light cannot pass through the polarizer 112, which in turn achieves a black display on the pixel array 2.

As described above, in the pixel array 2 in accordance with the present embodiment, applying voltage across the pixel electrodes 121*a* and the opposite electrode 121*b* generates an electric field, oblique to the substrate surface, which in turn causes the liquid crystal molecules to align in the oblique direction. Accordingly, the transmittance of the pixels are changeable through the level of the voltage applied to the pixel electrodes 121*a*, thereby realizing grayscale displays.

The pixel array 2 may be non-volatile or of a simple matrix. In the present embodiment, the pixel array 2 is volatile and of an active matrix as an example.

To describe the array 2 in more detail, it has multiple (in this case, n) data signal lines SL1 to SLn and multiple (in this case, m) scan signal lines GL1 to GLm intersecting with the data signal lines SL1 to SLn. Also, the pixel array 2 has pixels PIX(i,j), one for each combination of a data signal line SLi and a scan signal line GLj, where i is a given integer from 1 to n and j is a given integer from 1 to m. In the case of the present embodiment, the pixel PIX(i,j) is present at a location surrounded by two adjacent data signal lines SL(i-1), SLi and two-adjacent scan signal lines GL(j-1), GLj.

The pixel PIX(i,j) has a field effect transistor (switching element) SW(i,j) and a pixel capacitance Cp(i,j). For example, the field effect transistor SW(i,j) is connected at its gate to the scan signal line GLj and at the drain to the data signal line SLi. The capacitor Cp(i,j) is connected at one of the two electrodes (a pixel electrode 121*a*; will be detailed later) to the source of the field effect transistor SW(i,j). The other electrode (the opposite electrode 121*b;* detailed later) of the pixel capacitance Cp(i,j) is connected to a common electrode line which is shared among all the pixels PIX. See FIG. 5. The pixel capacitance Cp(i,j) comprises a liquid crystal capacitance CL(i,j) and an auxiliary capacitance Cs(i,j) which is added if necessary.

In the pixel PIX(i,j), selecting the scan signal line GLj turns on the field effect transistor SW(i,j). The voltage on the data signal line SLi appears across the pixel capacitance Cp(i,j). Then, deselecting the scan signal line GLj turns off the field effect transistor SW(i,j). The pixel capacitance Cp(i,j) retains the voltage when the transistor SW(i,j) is turned off. The transmittance of the liquid crystal varies with the applied voltage across the liquid crystal capacitance CL(i,j). Therefore, if the driver section 14 shown in FIG. 1 selects the scan signal line GLj and applies a voltage to the data signal line SLi in accordance with the video data D for the pixel PIX(i,j), the display state of the pixel PIX(i,j) can be varied in accordance with the video data D.

The driver section 14 outputs a voltage signal or another form of signal to select the scan signal lines GL1 to GLm. Also, the driver section 14, at predetermined timings, changes scan signal lines GLj to which the selecting signal is fed. Accordingly, the scan signal lines GL1 to GLm are sequentially selected at predetermined timings.

Further, the driver section 14 acquires video data D individually for the pixels PIX from video signal DAT4 fed from the video filter section 13 (in this case, the video signal DAT3 after video filtering). The driver section 14 supplies the individual pixels PIX(1,j) to PIX(n,j) on the currently selected scan signal line GLj with output signals in accordance with the video data D via the data signal lines SL1 to SLn. The liquid crystal needs be AC driven; the driver section 14 changes the polarity of the output signals accordingly. The driver section 14 controls the timings when to drive the signal lines (data signal lines and gate signal lines).

The pixels PIX(1,j) to PIX(n,j) control the voltage levels applied to the respective pixel electrodes 121*a* in accordance with the output signals on the associated data signal lines SL1 to SLn while the associated scan signal line GLj is being selected. Accordingly, the transmittance, hence the luminance, of the pixels PIX(1,j) to PIX(n,j) is controlled.

The scan signal line drive circuit 4 selects the scan signal lines GL1 to GLm sequentially. Therefore, the brightness of all the pixels PIX (1,1) to PIX(n,m) in the pixel array 2 can be specified according to the individual video data D. This enables updating of the image display on the pixel array 2. The description has so far assumed line sequential driving as an example; the description is equally applicable to dot sequential driving.

The video filter section 13 in accordance with the present embodiment generates the video signal DAT4 by video filtering the video signal DAT3. The video filtering is done based on, for example, user instructions, the type of the incoming video signal DAT1 (e.g., signal format or video signal source), or the properties of the pixel array 2. The video filtering may involve assisting grayscale level transitions of pixels so that the pixel array 2 can complete a response within a predetermined period (e.g., 1 frame period). Alternatively, the video filtering may involve image edge enhancement/smoothing, preset color correction in accordance with temperature, or a combination of any of these processes.

The resolution converter section 12 changes the resolution of the video signal DAT2 to match the resolution of the pixel array 2 based on, for example, the type of the incoming video signal DAT1 (e.g., interlace signal or another type of signal, or resolution). If the video signal DAT2 is an interlace signal, the resolution may be changed by converting the signal to a progressive signal (IP conversion). Alternatively, the resolution conversion may involve scaling or a combination of any of these processes.

The decoder section 11 generates the video signal DAT2 by decoding the coded video signal DAT1 by a decoding scheme in accordance with the video signal DAT1. The video signal DAT1 in accordance with the present embodiment is, for example, a signal encoded by a hybrid scheme of motion-corrective interframe prediction and DCT (discrete cosine transform). Examples of the video signal DAT1 include signals encoded in accordance with MPEG1 (Moving Picture Expert Group 1) or MPEG2 (Moving Picture Expert Group 2) standard which are widely used to make typical movies and other moving images available. Both motion correction and DCT divides the whole image into some minimal regions (e.g., an area comprising k×k pixels) in the generation of the video signal DAT1. Encoding methods are changed from one minimal region to another for high quality, high efficiency video compression.

Some of these encoding methods are suited for the encoding of still images, and some for the encoding of moving images. The video signal DAT1 carries not only encoded data of the minimal regions, but also information which identifies the encoding methods for the minimal regions of the image. Certain encoding methods suitable for moving image encoding are based on motion-corrective interframe prediction. Some of these methods involve correcting image changes based on vector information: a specific example is a motion vector differential encoding method.

The minimal region corresponds to a macroblock of MPEG1 and MPEG2. The encoding suitable for still images corresponds to intraencoding or intraframe encoding. The encoding suitable for moving images corresponds to motion vector-based encoding.

The decoder section 11 reproduces bitmap data for each minimal region from the video signal DAT1. The section 11 does so by identifying an encoding method for each minimal region of the image and applying a decoding method matching the encoding method. The decoder section 11 has a memory to store data for the minimal regions in the preceding or succeeding frame. When decoding data for a minimal region encoded by motion-corrective interframe prediction, the data for the same minimal region in the preceding or succeeding frame may be retrieved from the memory and used for the decoding.

The motion-adaptive grayscale level converter section 21 in accordance with the present embodiment decides whether the pixels given by the video signal DAT2 are in a moving image area. The decision is made based on information received from the decoder section 11 as to whether the minimal regions are encoded by encoding methods suitable for a moving image (minimal movie regions). For the pixels in a moving image area, the section 21 performs a predetermined grayscale level conversion for use on a moving image area. For the pixels in a non-moving image area, the section 21 performs no such conversion. The moving image area and the non-moving image area are intermediate regions made of multiple minimal regions. If the minimal region comprises 4×4 pixels or 8×8 pixels for example, the intermediate region preferably comprises 32×32 pixels.

Figure 6:
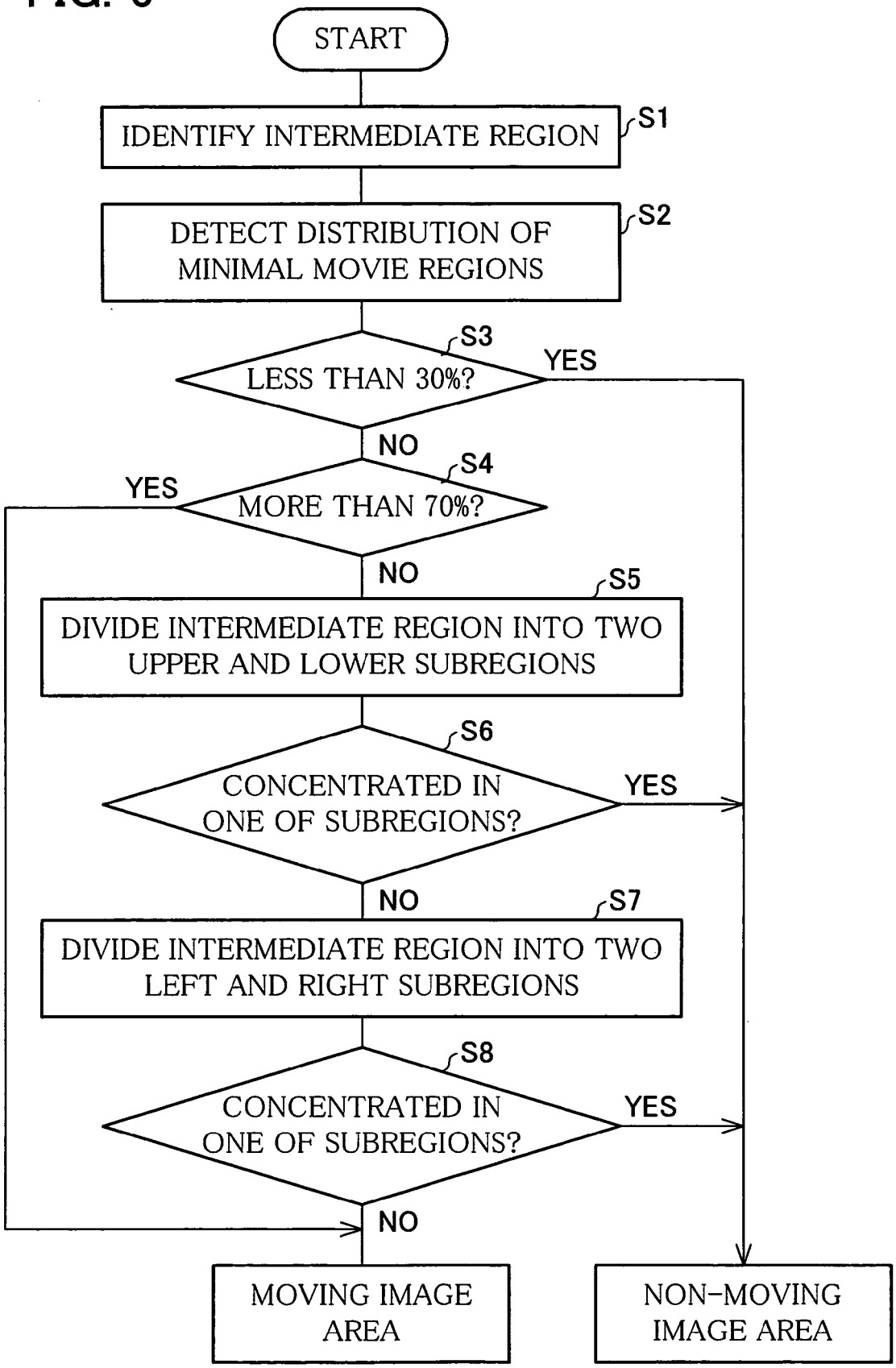
FIG. 6, depicting an operation of a motion-adaptive grayscale level converter section provided in the image display, is a flow chart illustrating an operation to detect a moving image area.

The motion-adaptive grayscale level converter section 21 makes the decision as illustrated in a flow chart in FIG. 6. In step 1 ("S1"), the motion-adaptive grayscale level converter section 21 identifies an intermediate region with a target pixel at the center. In S2, the section 21 detects the distribution of minimal movie regions in the intermediate region based on the information fed from the decoder section 11. If the minimal movie regions account for less than 30% of the intermediate region (YES in S3), the motion-adaptive grayscale level converter section 21 decides that the intermediate region is a non-moving image area.

If the minimal movie regions account for more than 70% of the intermediate region (YES in S4), the motion-adaptive grayscale level converter section 21 decides that the intermediate region is a moving image area.

Meanwhile, if the minimal movie regions account for 30% to 70% (NO in both S3 and S4), the motion-adaptive grayscale level converter section 21 continues to following steps S5 to S8 to decide whether the intermediate region is a moving image area.

In S5, the motion-adaptive grayscale level converter section 21 divides the intermediate region into two subregions, upper and lower, and counts the minimal movie regions in each subregion. If the minimal movie regions are concentrated in one of the subregions (YES in S6), the intermediate region is decided to be a non-moving image area. The threshold for the concentration is 3:7. These cases occur when the minimal movie regions in one of the subregions account for less than 30% or more than 70% of those in the whole intermediate region.

If otherwise decided in S6 (NO in S6), the motion-adaptive grayscale level converter section 21 divides the intermediate region into two subregions, left and right, and counts the minimal movie regions in each subregion (S7). If the minimal movie regions are concentrated in one of the subregions (YES in S8), the intermediate region is decided to be a non-moving image area. The same threshold of 3:7 is used. These cases occur when the minimal movie regions in one of the subregions account for less than 30% or more than 70% of those intermediate region.

If otherwise decided in S8 (NO in S8), the motion-adaptive grayscale level converter section 21 decides that the intermediate region is a moving image area.

For convenience in description, FIG. 6 shows that S5 and S6 are followed by S7 and S8. This part of operation may be modified: S5 and S6 may be performed after S7 and S8, and still achieve similar effects, as long as the intermediate region is decided to be a moving image area when S6 and S8 find that the minimal movie regions are evenly distributed in the subregions, and otherwise to be a non-moving image area.

In the present embodiment, the intermediate region is decided to be a non-moving image area if the S3 decision is YES and to be moving image area if the S4 decision is YES. S5 to S8 may be carried out in these cases too. However, the decision as to moving/non-moving image area based on a YES decision in S3 or S4 in most instances match the decision in S5 to S8. The decision making steps in FIG. 6 therefore require less computation.

The motion-adaptive grayscale level converter section 21 in accordance with the present embodiment alters grayscale level data for those pixels in a moving image area. When the video signal DAT1 indicates a black display for the pixels, this alteration makes the voltage applied to the pixel electrodes of those pixels in a moving image area higher than the voltage applied to the pixel electrodes of those pixels in a non-moving image area. The alteration also makes the applied voltage more than or equal to a predetermined voltage. Note that the above pixel electrodes of the pixels to which the voltage is applied are actually the pixel electrodes of the pixels in the pixel array 2 corresponding to those pixels in a moving image area.

Specifically, the motion-adaptive grayscale level converter section 21 sets the grayscale level data for the pixels to a first grayscale level C1 corresponding to a predetermined voltage if the grayscale level data for the pixels decided to be in a moving image area is lower than the first grayscale level C1. For example, if the video signal DAT2 comprises grayscale level data of a γ value of 2.2, and the grayscale level data represents 256 grayscale levels, the first grayscale level C1 is set to grayscale level 32. In contrast, for those pixels which have been decided to be in a non-moving image area, the motion-adaptive grayscale level converter section 21 performs no particular-corrections on the grayscale level data, outputting the data as it is.

Figure 7:
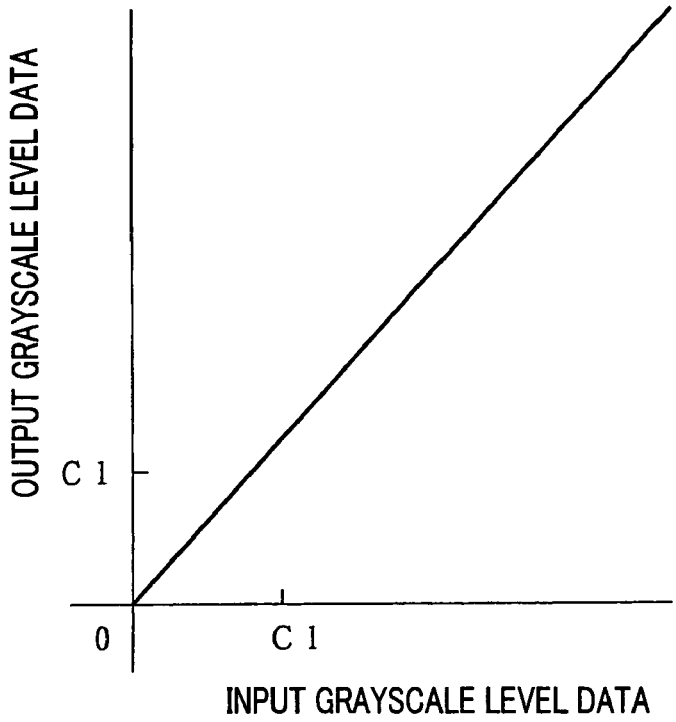
FIG. 7 is a graph representing a relationship between input grayscale level data and output grayscale level data in a non-moving image area.
Figure 8:
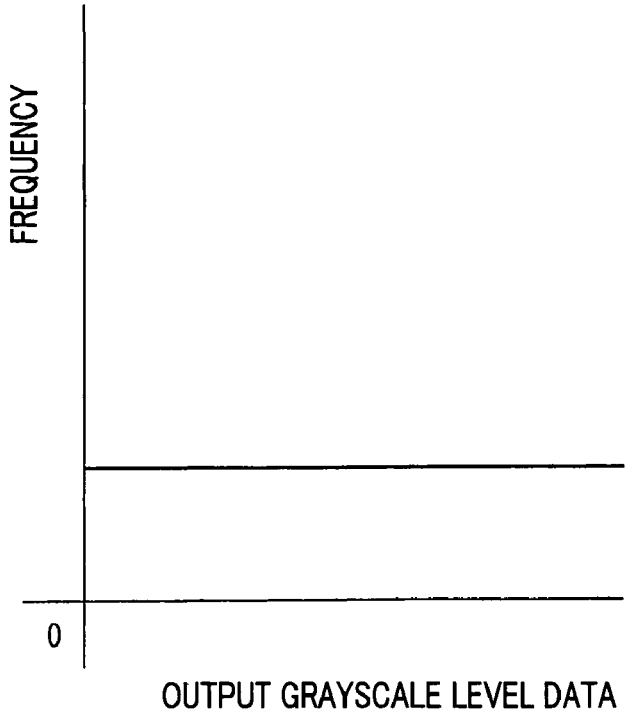
FIG. 8 is a histogram of output grayscale level data in a non-moving image area.

In this configuration, for the pixels in the non-moving image area, the grayscale level data (input grayscale level data) as given by the video signal DAT2 and the grayscale level data (output grayscale level data) as given by the video signal DAT3 have the relationship shown in FIG. 7. The relationship is represented by a straight line extending from grayscale level 0 as the base point. If all the possible grayscale level data values appear at the same frequency in the grayscale level data for the pixels given by the video signal DAT2, the output grayscale level data may be represented by a histogram in FIG. 8. The grayscale level data values appear at the same frequency in the output grayscale level data.

Figure 9:
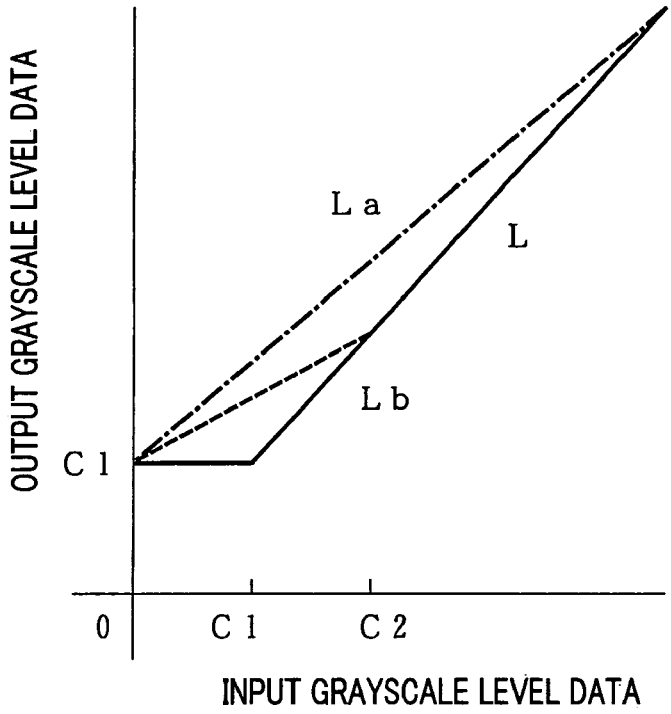
FIG. 9 is a graph representing a relationship between input grayscale level data and output grayscale level data in a moving image area.
Figure 10:
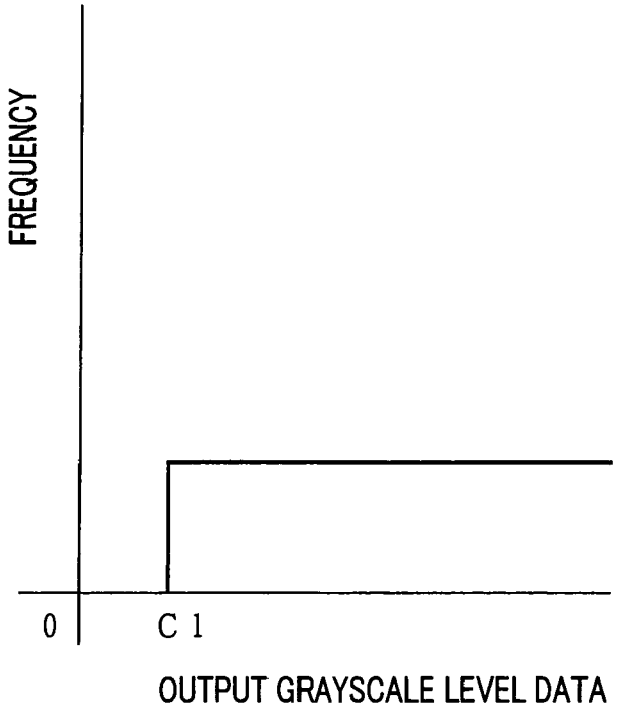
FIG. 10 is a histogram of output grayscale level data in a moving image area.

In contrast, as to the pixels in a moving image area, the relationship between the input grayscale level data and the output grayscale level data is shown in FIG. 9. The output level data stays at the first grayscale level C1 for input level data lower than the first grayscale level C1 (in this example, grayscale level 32). When the input level data exceeds the first grayscale level C1, the output grayscale level data increases with an increase in the input grayscale level data. In this last case, if the grayscale level data values in the input grayscale level data appear at the same frequency, the histogram of the output grayscale level data is as shown in FIG. 10. Before exceeding the first grayscale level C1, the frequencies of the grayscale level data values are 0. At values exceeding that, the frequencies are constant at a value greater than 0.

The liquid crystal cell of vertically aligned mode and normally black mode appears the darkest when the liquid crystal molecules are substantially vertically aligned. In this state, the contrast ratio is best improved when producing a black display. Such a liquid crystal cell however shows a significantly slower response speed when the liquid crystal molecules are substantially vertically aligned than when the liquid crystal molecules are inclined.

To describe it in more detail, when the liquid crystal molecules are substantially vertically aligned, the alignment orientation (in-plane component of the alignment direction on the substrate) is yet to be definite. When voltage is applied to the pixel electrodes 121*a*, the alignment orientation of some of the liquid crystal molecules in the pixels remains to be indefinite if the applied voltage is low. This phenomenon may occur, for example, in the case: mentioned above where γ=2.2 and the voltage applied is intended to display a lower grayscale level than grayscale level 32 in the pixel array 2 capable of producing 256 grayscale levels. These liquid crystal molecules are yet to align. Once the applied voltage increases, both the alignment orientation and the tilt angle (angle between the normal to the substrate and the alignment direction) become definite. The result is a relatively slow response speed. Meanwhile, if the applied voltage is high, that is, if the alignment orientation is already definite for almost all the liquid crystal molecules in the pixels and it is only the tilt angle that is yet to be definite, the response speed is relatively fast. This phenomenon may occur, for example, when the voltage applied is intended to display a higher grayscale level than grayscale level 32.

As demonstrated in the above, the liquid crystal cell of vertically aligned mode and normally black mode exhibits far lower response speed when it is producing grayscale levels below a certain grayscale level than when it is producing grayscale levels in excess of the grayscale level.

Figures 11, 12:
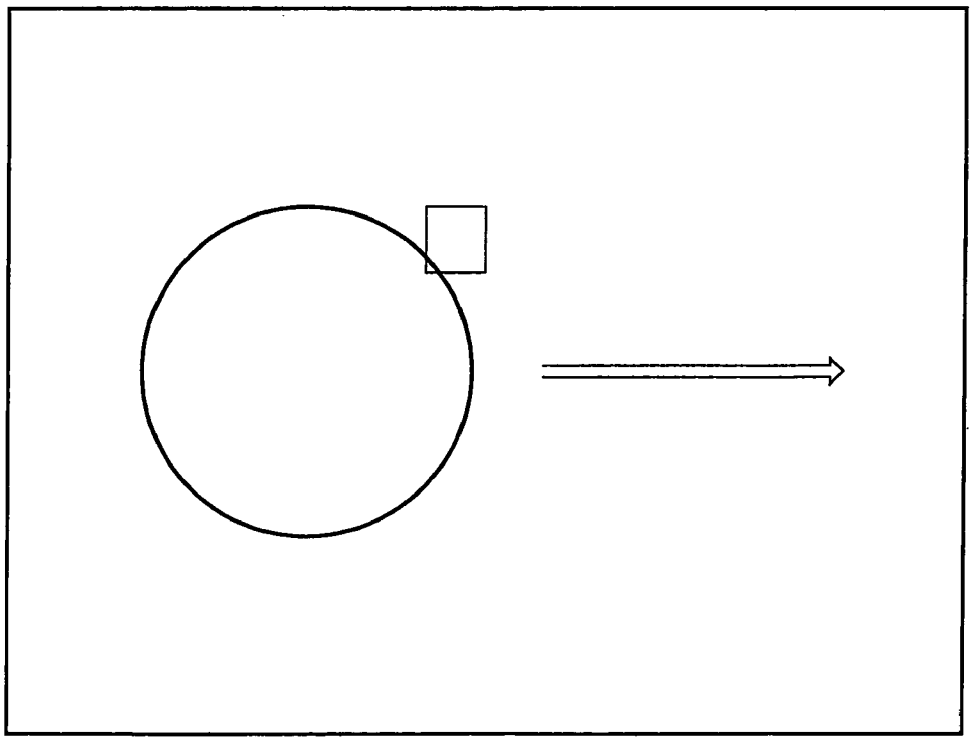
FIG. 11, representing an operation of the liquid crystal cell, is a drawing showing a response speed for every combination of starting grayscale levels and finishing grayscale levels.
FIG. 12, illustrating causes of motion blurriness, is a drawing of an exemplary graphic display.

The following will describe in more detail local response speed reductions and resultant image quality degradation in reference to FIG. 11 and FIG. 12. FIG. 11 gives an example of measurements of response time of a vertically aligned liquid crystal panel used in normally black mode for some different grayscale levels.

The liquid crystal panel, which makes an object to be measured on, exhibits 0-90% response on the generally accepted scale (such response that the output changes from 0 to 90% when the input changes from 0 to 100%). The panel does not make an especially slow monitor. The response times of the liquid crystal panel are no more than 30 msec, including the response times for both 0-255 grayscale level rises (grayscale level-increasing changes) and 255-0 grayscale level decays (grayscale level-decreasing changes).

However, comparing the rise response times and decay response times for different grayscale levels, the rise response times from about grayscale level 0 to middle levels vastly differ from the decay response times from middle levels to about 0. The difference can reach one frame time or even longer in some cases.

In such a situation, if a middle-level observation object A moves on a black background (the observation object and the background may be reversed in terms of grayscale level) as shown in FIG. 12 for example, the whole display appears black for a period. This is because transitions are substantially quick from middle levels to black, but hardly occurs from black to middle levels in an intermediate region X in the vicinity of the observation object A.

If such a period lasts one frame period or longer, the object appears to be moving while blinking, which makes the video display look very unnatural. FIG. 11 demonstrates that the slow rise response times improve progressively with an increase of the starting grayscale level from 0. FIG. 11 shows a response time in milliseconds for every combination of starting grayscale levels and finishing grayscale levels when there is an instruction received for a grayscale level transition from a starting grayscale level to a finishing grayscale levels.

For example, FIG. 11 shows no slower rise response times than 27.6 msec for transitions starting at grayscale level 32. These response times cause no unnatural look in the video display. This means that if no grayscale level 32 or lower grayscale levels are used in producing a display on the liquid crystal panel, the practical response speed is greatly improved.

As a comparative example, suppose that to limit response speed reductions, the voltage applied to the pixels in the pixel array 2 is always set relatively high in producing a black display. The contrast ratio will fall when producing still image displays where response speed reductions do not pose any problem, which leads to poor still image reproduction capability.

In contrast, in the image display 1 in accordance with the present embodiment, the motion-adaptive grayscale level converter section 21 decides whether the pixels in the video signal DAT2 are in moving image areas. The section 21 further performs a grayscale level conversion for moving image areas on those pixels in moving image areas, but not on those in the non-moving image area. Therefore, the display 1 is capable of limiting image quality degradation due to insufficient response when displaying a moving image, while maintaining the contrast ratio achieved for a still image display.

When displaying a moving image, the contrast ratio falls slightly due to this grayscale level conversion. For example, the grayscale level 32 in the 256 grayscale levels is black with a luminance about 1% that of white if a typical $\gamma=2.2$ is assumed. The contrast ratio falls to about 100. Unlike cathod ray tubes and other displays based on momentary, impulse-type display lights, the liquid crystal display panel is based on a hold-type display light which varies continuously with time. The liquid crystal display panel inherently suffers from blurriness when displaying moving images. A viewer can often notice flickering and blurred images due to insufficient response. Therefore, the poor contrast ratio in displaying moving images is fairly tolerable when compared with flickering and blurriness due to insufficient response.

The motion-adaptive grayscale level converter section 21 in accordance with the present embodiment receives, from the decoder section 11, information as to whether the minimal regions are encoded by suitable encoding methods for a moving image (minimal movie region). The information is referenced in determining whether the pixels are in moving image areas. Therefore, the section 21 may share, with the decoder section 11, part of the circuit which decides whether the pixels are in moving image areas. This is different from a structure where there is provided a separate circuit which decides whether the pixels are in moving image areas based only on the video signal DAT2. The section 21 therefore has a simpler structure and more reliable in determining whether the pixels are in moving image areas.

Differently put, the video signal DAT1 in accordance with the present embodiment is capable of representing the video in each frame as a combination of still image data and vector data generated by comparison with the video in another frame. If the motion-adaptive grayscale level converter section 21 decides from the information received from the decoder section 11 that a minimal region contains a part given by vector data, the section 21 regards the minimal region as being one of a moving image.

Here, the vector data and still image data are both carried on the video signal DAT1. The decision as to whether the data is vector data or still image data is always done in the process of identifying (e.g., decoding) the grayscale level data representing the grayscale levels of the pixels on the basis of the video signal.

Therefore, part of the determining process which is essential to the process of identifying grayscale level data representing the grayscale levels of the pixels on the basis of the video signal may be used as part of the process of determining whether the minimal regions are those of a moving image, so as to determine whether the grayscale levels should be converted. This reduces the necessary computing and circuit size over cases where the decisions are made separately.

The part where changes are given by a vector is where the observe can feel the changes. Therefore, by subjecting this part to a grayscale level conversion for a moving image area, serious insufficient response in the grayscale level transition which could occur in normal situations (with no grayscale level conversion) can be eased only in the moving image.

The foregoing description has discussed a structure to decide whether a minimal region contains a part given by vector data, as a example of the structure to decide whether the minimal regions are minimal movie regions on the basis of the data carried by the video signal DAT1. This is not the only possibility. The motion-adaptive grayscale level converter section 21 may decide whether the pixels are in minimal movie regions on the basis of, for example, an instruction to combine a still image layer and a moving image layer to produce a screen in a game or an instruction to separate picture drawing by an interruption process on a PC. In these cases, the process of combining a still image layer and a moving image layer and the process of separating picture drawing are essential to the process of displaying a video signal carrying data representing a still image layer and a moving image layer and a video signal carrying an instruction to separate picture drawing on the pixel array 2. Therefore, part of a decision making process which is essential to the process of identifying the grayscale level data representing the grayscale levels of the pixels on the basis of a video signal (process up to the display by the pixel array 2) may be used as part of the process of deciding whether the minimal regions are those of a moving image, so as to decide whether to perform a grayscale level conversion. This reduces the necessary computing and circuit size over cases where the decisions are made separately.

FIG. 1 shows, for convenience, an example where the motion-adaptive grayscale level converter section 21 immediately follows the decoder section 11. Provided that a minimal movie region deciding process for decoding can be used also as a minimal movie region deciding process for grayscale level conversion, for example, the decoder section 11 and the motion-adaptive grayscale level converter section 21, if integrated, still achieve similar effects.

If a grayscale level conversion is done for each minimal movie region, minimal regions with different contrasts are displayed tangled. Block separation (block-like uneven luminance) may possibly become visible, which could create an unnatural video display. In addition, regarding relatively still areas like the background around a moving area of a moving image observation object, insufficient response cannot be improved when the minimal regions included in the area are dark.

In contrast, the motion-adaptive grayscale level converter section 21 in accordance with the present embodiment decides whether the pixels are in moving image areas not by the minimal movie region, but by the intermediate region unit made up of multiple minimal movie regions. Therefore, the grayscale level conversion can be done on the moving areas of a moving image observation object and the background around its periphery too. This limits occurrence of insufficient response in an area with the slowest response with more natural grayscale level display. In addition, even when the minimal regions in the background area are displayed dark, insufficient response is addressed. To further restrain visible block separation, the motion-adaptive grayscale level converter section 21 may perform an additional spatial lowpass filtering.

Incidentally, the foregoing description discussed the motion-adaptive grayscale level converter section 21 deciding whether the pixels are in moving image areas in accordance with the flow chart in FIG. 6. The decision method is not limited to this. For example, as shown in FIG. 13, the decision may be made in accordance with the position of center of gravity.

Figure 13:
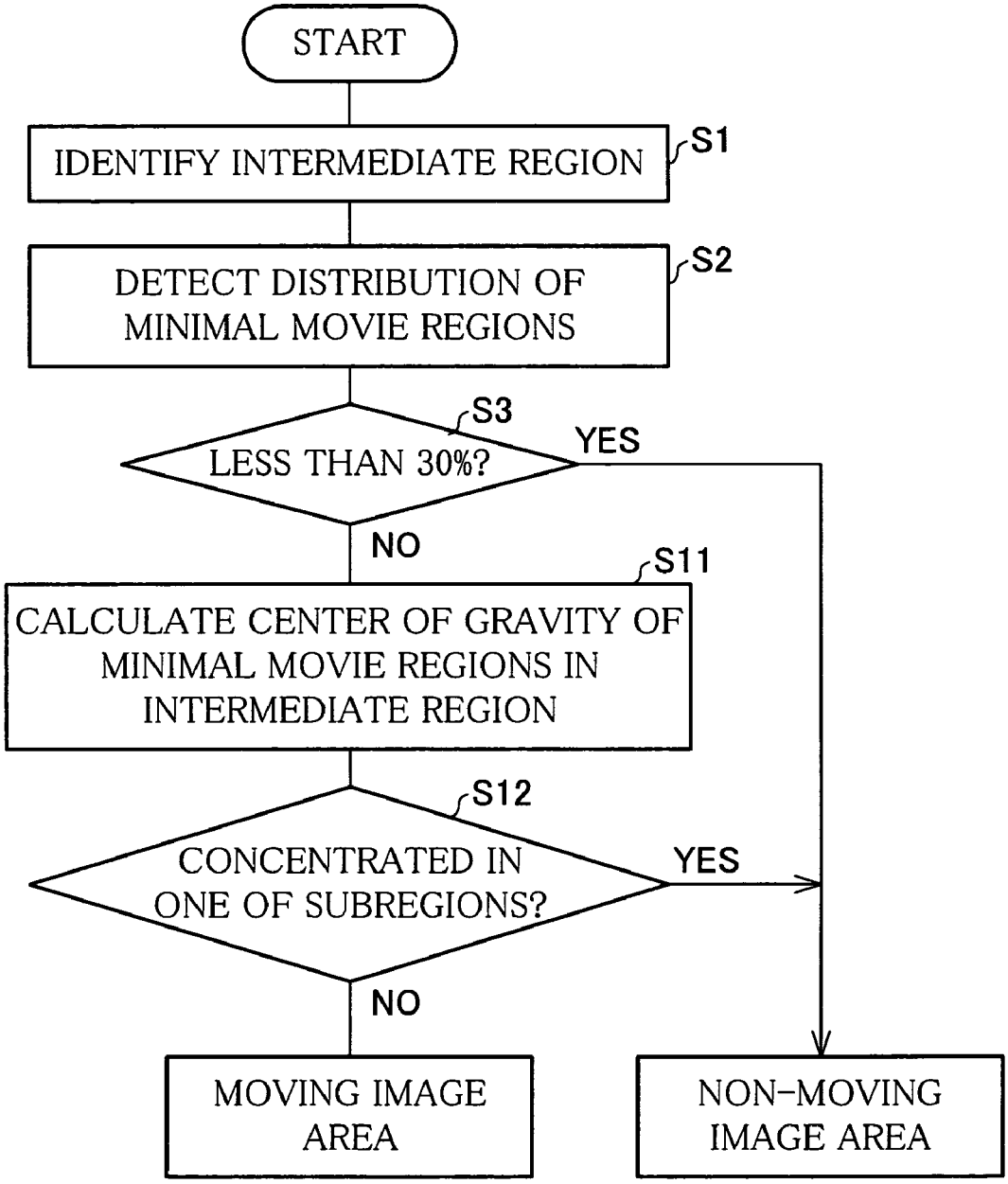
FIG. 13, depicting a variation, is a flow chart illustrating an operation for a motion-adaptive grayscale level converter section to detect a moving image area.

Specifically, following the decision method in FIG. 13 is employed, the motion-adaptive grayscale level converter section 21 carries out steps similar to S1 to S3 in FIG. 6. If minimal movie regions account for less than 30% of an intermediate region, the intermediate region is decided to be a non-moving image area.

In contrast, if more than 30%, the motion-adaptive grayscale level converter section 21 carries out S11 in stead of S4 to S8. In S11, the position of the center of gravity of the minimal movie regions is calculated. If the position of the center of gravity is in a predetermined area (YES in S12), the section 21 regards the intermediate region as containing more than a threshold number of evenly distributed minimal movie regions and decides that the intermediate region is a moving image area. On the other hand, if the position of the center of gravity is not in a predetermined area (NO in S12), the section 21 regards the intermediate region as containing more than a threshold number of minimal movie regions, but distributed unevenly, and decides that the intermediate region is a non-moving image area.

To describe it in more detail, the motion-adaptive grayscale level converter section 21 calculates the position (X,Y) of the center of gravity of the minimal movie regions in the following manner. Using normalized coordinates (x,y) to express the positions of the minimal regions in the intermediate region so that the entire intermediate region is represented by a space from (0,0) to (1,1), the position (X,Y) of the center of gravity is given by equations (1), (2):

$$X = \sum_{i=1}^{n} \sum_{j=1}^{n} \frac{fx(x_{(i,j)}, y_{(i,j)})}{m} \tag{1}$$

$$Y = \sum_{i=1}^{n} \sum_{j=1}^{n} \frac{fy(x_{(i,j)}, y_{(i,j)})}{m} \tag{2}$$

In equations (1), (2), $(x_{(i,j)}, y_{(i,j)})$ indicates the position of a given minimal region (i,j). The intermediate region contains n×n minimal regions, and i and j are integers from 1 to n. In addition, $fx(x_{(i,j)}, y_{(i,j)})$ and $fy(x_{(i,j)}, y_{(i,j)})$ are functions whose values are dictated depending on whether the minimal region at $(x_{(i,j)}, y_{(i,j)})$ is a minimal movie region or not. If it is a minimal movie region, $fx(x_{(i,j)}, y_{(i,j)})$ and $fy(x_{(i,j)}, y_{(i,j)})$ are $x_{(i,j)}$ and $y_{(i,j)}$ respectively. If not, $fx(x_{(i,j)}, y_{(i,j)})$ and $fy(x_{(i,j)}, y_{(i,j)})$ are both equal to 0. Further, m is the number of minimal movie regions in the intermediate region.

If the position (X,Y) of the center of gravity of the minimal movie regions calculated with equations (1), (2) satisfies both $0.3<X<0.7$ and $0.3<Y<0.7$, the motion-adaptive grayscale level converter section 21 regards the minimal movie regions as being evenly distributed in the intermediate region and decides that the intermediate region is a moving image area.

The decision methods in FIGS. 6, 13 are mere examples. Similar effects are achieved if minimal regions are defined as multiple parts into which the video of each frame is divided, the intermediate region is made up of multiple minimal regions, and it is decided whether pixels are in moving image areas or not in accordance with whether an intermediate region containing the pixels contains more than a threshold number of evenly distributed minimal regions of a moving image.

In addition, the foregoing description has discussed, as a grayscale level conversion method after determining that the pixels are in moving image areas, a conversion method whereby the relationship between the input grayscale level data and the output grayscale level data is represented by a flat line up to the first grayscale level C1 as indicated by L in FIG. 9. This however is not the only possibility.

Similar effects are achieved from any conversion method whereby the output grayscale level data contains no first grayscale level C1 or lower grayscale levels. As an example, for example, the motion-adaptive grayscale level converter section 21 may perform such a grayscale level conversion that the relationship between the input grayscale level data and the output grayscale level data is represented by the straight line La in FIG. 9 where the output grayscale level data is the first grayscale level C1 when the input grayscale level data is 0 and monotonically increases with an increase of the input grayscale level data.

According to the structure, as a grayscale level conversion method after determining that the pixels are in moving image areas, the grayscale level data is converted to converted grayscale level data by a linear expression about grayscale level data. Therefore, unlike a structure where grayscale levels darker than the first grayscale level C1 are replaced by the first grayscale level C1 (indicated by L in the figure), the ratio of the grayscale levels given by the input grayscale level data and the grayscale levels given by the output grayscale level data can be held constant at around the first grayscale level C1. As a result, image quality degradation (distorted tone curve, etc.) due to a change of the ratio can be limited.

The foregoing description has discussed conversions whose properties are represented by a straight line. Alternatively, the conversion may be done so that its properties may be represented by a curve. The straight line conversion however has an advantage in that it requires less computing and circuit size.

In addition, as another example, the grayscale level conversion may be done so that the relationship between the input grayscale level data and the output grayscale level data may be represented by a broken line Lb in FIG. 9. Specifically, the grayscale level conversion method presets a second grayscale level C2 which is higher than the first grayscale level C1. When the input grayscale level data is from 0 to the second grayscale level C2, the input grayscale level data is converted to the output grayscale level data by a linear function of the input grayscale level data.

The linear function is specified so that the output grayscale level data is equal to the first grayscale level C1 when the input grayscale level data is 0, and the output grayscale level data is equal to the second grayscale level C2 when the input grayscale level data is equal to the second grayscale level C2. In addition, the second grayscale level C2 is specified to such a value that the inclination of the linear function is unlikely to cause rounding errors(e.g., grayscale level 64 in the FIG. 9 example).

According to the arrangement, the ratio of the grayscale levels given by the input grayscale level data and the grayscale levels given by the output grayscale level data can be made constant at around the first grayscale level C1. In addition, unlike the properties Lb where all the input grayscale level data is converted to the output grayscale level data through one linear function, the second grayscale level C2 can be specified so as to restrict rounding errors in linear expression-based grayscale level conversion. Therefore, image quality degradation due to rounding errors can be limited without adding to the required computing or circuit size to restrict rounding error occurrences. Further, changes of the ratio at around the second grayscale level C2 can be limited when compared with changes of the ratio at around the first grayscale level C1 if the grayscale level conversion is done as indicated by La. The resultant motion-adaptive grayscale level converter section 21 is well-balanced in necessary computing, circuit size, and image quality.

In addition, the foregoing description has discussed the image display 1 containing the resolution converter section 12 and the video filter section 13. In an arrangement where a minimal movie region deciding process for decoding is used as a minimal movie region deciding process for grayscale level conversion as in the present embodiment, however, similar effects are achieved without these members 12, 13.

Embodiment 2

The first embodiment described a minimal movie region deciding process for decoding being used as a minimal movie region deciding process for grayscale level conversion. In contrast, the present embodiment will describe a minimal movie region deciding process for resolution conversion being used as a minimal movie region deciding process for grayscale level conversion. In the present embodiment, the decoder section 11 and the video filter section 13 may be omitted where they are not needed. The following description however assumes, as an example, that these members are included as in the first embodiment. The decoder section 11 is not needed when the input video signal DAT1 is uncompressed video signal (bitmap image video signal) for example, The video signal is fed to the resolution converter section 12.

Figure 14:
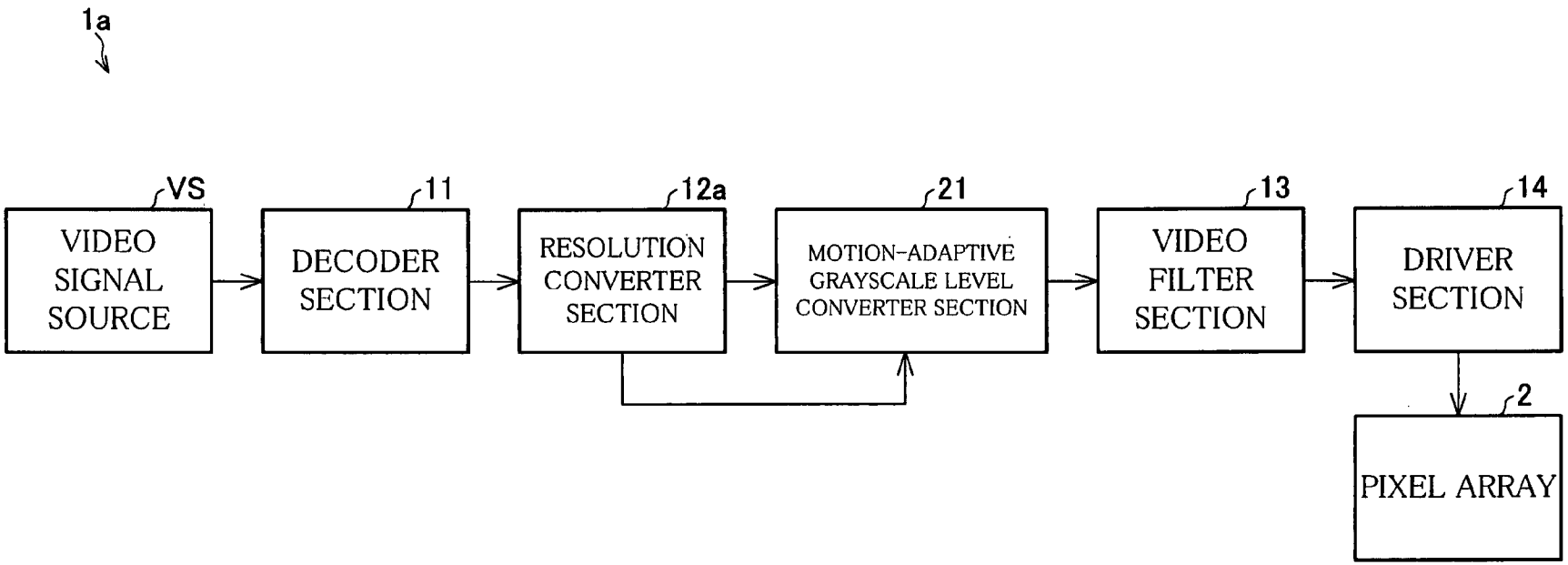
FIG. 14, depicting another embodiment of the present invention, is a block diagram illustrating a structure of primary components of an image display.

An image display la in accordance with the present embodiment as shown in FIG. 14 has a substantially similar structure as in FIG. 1. The motion-adaptive grayscale level converter section 21 follows a resolution converter section 12*a*. The motion-adaptive grayscale level converter section 21 converts the grayscale levels given by the video signal DAT3 from the resolution converter section 12*a* based on information from the resolution converter section 12*a*. The resolution converter section 12*a* in the present embodiment is an equivalent to the video processing means in claims.

Simply scaling up or down in resolution conversion may cause jaggy or missing lines. For high quality resolution conversion, reference is preferably made to the grayscale level data for surroundings pixels and the grayscale level data for the pixels in adjacent frames (or fields). In addition, generally, suitable resolution conversion procedures differ depending on whether they are applied to a moving image or a still image. Resolution conversion methods are preferably changed depending on whether the method is applied to a moving image or a still image. Further, a display screen may contain both those areas which can be considered moving images and to which a resolution conversion method suitable for a moving image is preferably applied and those areas which can be considered substantially still images and to which a resolution conversion method suitable for a still image is preferably applied. Therefore, for higher quality resolution conversion, an image is preferably divided into minimal regions which are decided to be either a moving image or a still image to apply suitable resolution conversion methods to the regions.

The resolution converter section 12*a* in accordance with the present embodiment is capable of motion adaptive resolution conversion (e.g., scaling and IP conversion) where motion information is separated and interpolated for more accurate conversion. In a resolution conversion, the section 12*a* divides an image given by the input video signal DAT2 into minimal regions and decides whether the minimal regions are minimal movie regions. The section 12*a* then converts the resolution of the video signal DAT2 by suitable resolution conversion methods in accordance with whether the minimal regions are minimal movie regions to generate the video signal DAT3.

The resolution converter section 12*a* in accordance with the present embodiment can transfer information as to whether the minimal regions are minimal movie regions to the motion-adaptive grayscale level converter section 21. This is similar to the decoder section 11 of the first embodiment. The motion information detected in the resolution conversion is mostly edge information, in which case the resolution converter section 12*a* can transfer minimal regions enclosing the edge given by information as minimal movie regions to the motion-adaptive grayscale level converter section 21.

According to the arrangement, if the pixels are in moving image areas, a grayscale level conversion for moving image areas can be done as in the first embodiment. Therefore, image quality degradation due to insufficient response when displaying a moving image can be limited while the contrast ratio achieved for a still image display is being maintained as in the first embodiment. In addition, it is decided whether the pixels are in moving image areas by the intermediate region made up of multiple minimal regions as in the first embodiment. This limits occurrences of insufficient response in an area with the slowest response with more natural grayscale level display. In addition, even when the minimal regions in the background area are displayed dark, insufficient response is addressed.

The motion-adaptive grayscale level converter section 21 in accordance with the present embodiment does not make reference to the information from the decoder section 11 like in the first embodiment. Instead, the section 21 receives, from the resolution converter section 12*a*, information as to whether the minimal regions are to be resolution converted by a suitable resolution conversion method for moving images. This information is referenced in deciding whether the pixels are in moving image areas. Therefore, the section 21 may share, with the resolution converter section 12*a*, part of the circuit which decides whether the pixels are in moving image areas. This is different from a structure where there is provided a separate circuit which decides whether the pixels are in moving image areas based only on the video signal DAT3. The section 21 therefore can decide whether the pixels are in moving image areas with a simpler structure than the structure with a separate circuit.

FIG. 14 shows, for convenience, an example where the motion-adaptive grayscale level converter section 21 immediately follows the resolution converter section 12*a*. Provided that a minimal movie region deciding process for resolution conversion can be used also as a minimal movie region deciding process for grayscale level conversion, for example, the resolution converter section 12*a* and the motion-adaptive grayscale level converter section 21, if integrated, still achieve similar effects.

Embodiment 3

The present embodiment will describe a minimal movie region deciding process for video filtering used as a minimal movie region deciding process for grayscale level conversion. In the present embodiment, the decoder section 11 and the resolution converter section 12 may be omitted where they are not needed. The following description however assumes, as an example, that these members are included as in the first embodiment.

Figure 15:
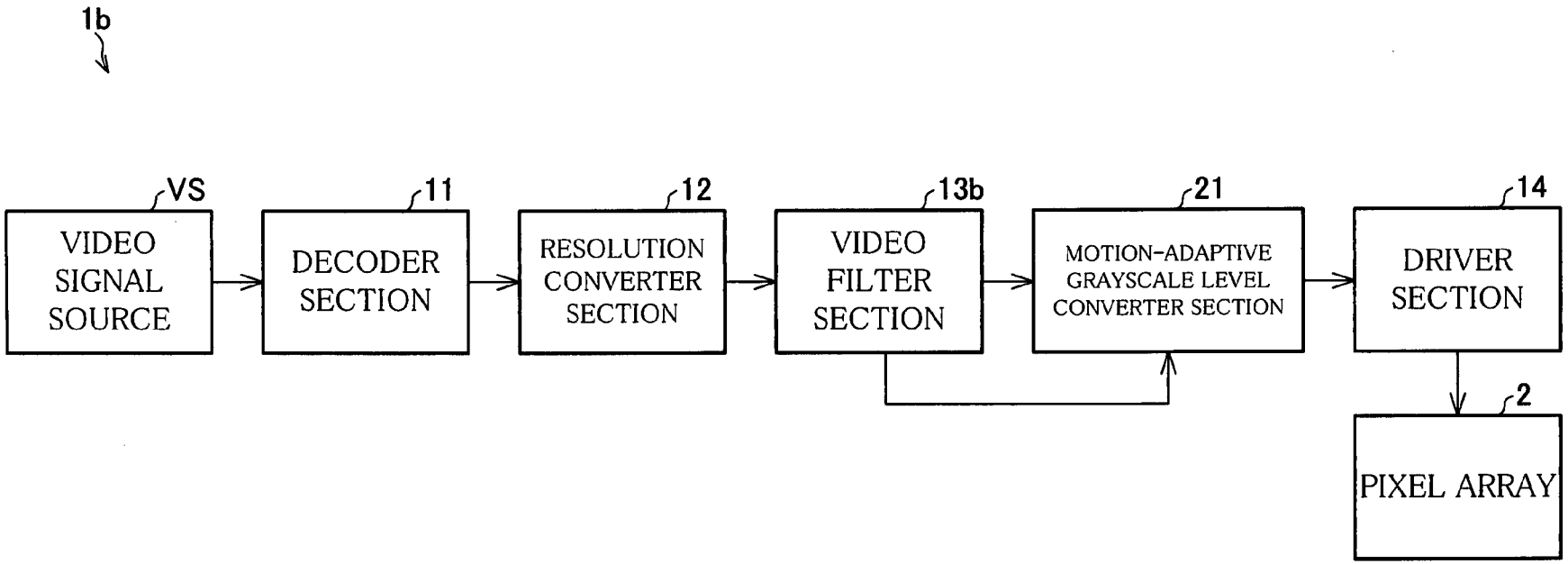
FIG. 15, depicting a further embodiment of the present invention, is a block diagram illustrating a structure of primary components of an image display.

An image display 1*b* in accordance with the present embodiment as shown in FIG. 15 has a substantially similar structure as in FIG. 1. The motion-adaptive grayscale level converter section 21 follows a video filter section 13*b*. The motion-adaptive grayscale level converter section 21 converts the grayscale levels given by the video signal DAT4 from the video filter section 13*b* based on information from the video filter section 13*b*. The video filter section 13*b* in the present embodiment is an equivalent to the video processing means in claims.

Some video filtering techniques, such as edge enhancement/smoothing, achieve better quality when adjacent frame images are also referenced than when only one frame image is referenced. In addition, a display screen may contain both those areas which can be considered moving images and to which video filtering suitable for a moving image is preferably applied and those areas which can be considered substantially still images and to which video filtering suitable for a still image is preferably applied. Therefore, for higher quality video filtering, some video filters divide an image into minimal regions and decide whether the minimal regions are moving images to apply suitable methods for video filtering.

The video filter section 13*b* in accordance with the present embodiment makes a decision as to moving images for video filtering in this manner. For video filtering (e.g., edge enhancement/smoothing), the section 13*b* divides an image given by the input video signal DAT3 (in this case, the video signal from the resolution converter section 12) into minimal regions and decides whether the minimal regions are minimal movie regions. The section 13*b* then carries out video filtering on the video signal DAT3 by suitable methods in accordance with whether the minimal regions are minimal movie regions to generate the video signal DAT4.

Further, the video filter section 13*b* in accordance with the present embodiment can transfer information as to whether the minimal regions are minimal movie regions to the motion-adaptive grayscale level converter section 21. This is similar to the decoder section 11 of the first embodiment.

According to the arrangement, if the pixels are in moving image areas, a grayscale level conversion for moving image areas can be done as in the first embodiment. Therefore, image quality degradation due to insufficient response when displaying a moving image can be limited while the contrast ratio achieved for a still image display is being maintained as in the first embodiment. In addition, it is decided whether the pixels are in moving image areas by the intermediate region made up of multiple minimal regions as in the first embodiment. This limits occurrences of insufficient response in an area with the slowest response with more natural grayscale level display. In addition, even when the minimal regions in the background area are displayed dark, insufficient response is addressed.

The motion-adaptive grayscale level converter section 21 in accordance with the present embodiment does not make reference to the information from the decoder section 11 like in the first embodiment. Instead, the section 21 receives, from the video filter section 13*b*, information as to whether the minimal regions are to be resolution converted by a suitable resolution conversion method for moving images. This information is referenced in deciding whether the pixels are in moving image areas. Therefore, the section 21 may share, with the video filter section 13*b*, part of the circuit which decides whether the pixels are in moving image areas. This is different from a structure where there is provided a separate circuit which decides whether the pixels are in moving image areas based only on the video signal DAT4. The section 21 therefore can decide whether the pixels are in moving image areas with a simples structure than the structure with a separate circuit.

FIG. 15 shows, for convenience, an example where the motion-adaptive grayscale level converter section 21 immediately follows the video filter section 13*b*. Provided that a minimal movie region deciding process for video filtering can be used also as a minimal movie region deciding process for grayscale level conversion, for example, the video filter section 13*b* and the motion-adaptive grayscale level converter section 21, if integrated, still achieve similar effects.

The embodiments so far have described structures where the output grayscale level data for those pixels in moving image areas is specified not to be darker than the predetermined first grayscale level C1. This is not the only possibility.

The motion-adaptive grayscale level converter section 21 may be adapted to compare with cases where those parts in the moving image areas are displayed as still images and change the output grayscale level data for the pixels to a value instructing for a brighter grayscale display if the pixels are in moving image areas and the input grayscale level data for the pixels is darker than the first grayscale level, C1. The luminance of pixels driven based on the output grayscale level data can be changed to a value away from black. The response speed of the pixels can be improved to some extent. Image quality degradation due to insufficient response when displaying a moving image can be limited to some extent.

As described in the embodiments, however, if the output grayscale level data for the pixels is changed so as not to be darker than the first grayscale level C1, the areas of close-to-black grayscale levels and where the response speed decreases drastically can be surely avoided when the pixels in moving image areas are driven. Image quality degradation due to insufficient response when displaying a moving image can be further limited.

The embodiments have taken the decoder section 11, the resolution converter section 12*a*, or the video filter section 13*b* as an example, and described that the motion-adaptive grayscale level converter section 21 intervening between the video signal source VS and the pixel array 2 receives information as to whether the minimal regions are minimal movie regions from another member to decide based on that information whether the pixels are in moving image areas. This is not the only possibility. The section 21 may decide whether the pixels are in moving image areas based on an input video signal independently from the other members.

The embodiments have described that the motion-adaptive grayscale level converter section 21 alters grayscale level data to change the luminance of the pixels to a value away from black. Alternatives are possible. For example, the driver section 14 may change the luminance of the pixels to a value away from black by changing the applied voltage to the pixels in the pixel array 2 for example.

In any of these cases, when an image has moving image areas, similar effects are achieved if the signal values for those pixels in the moving image areas for which there are instructions to produce a darker grayscale level display than a predetermined first grayscale level are changed to values instructing for a brighter grayscale display than the cases where those parts in the moving image areas of the image are displayed as still images.

The embodiments, where the motion-adaptive grayscale level converter section 21 references a decision of a moving image decision making process performed by another member to decide whether the pixels are in moving image areas, requires less computing and circuit size than the structure where the section 21 makes a decision independently from the other members.

The embodiments have assumed that the liquid crystal cell 111 is structured as shown in FIG. 2 through FIG. 4 and that the alignment direction of the liquid crystal molecules in the pixels are divided into four. This is not the only possibility.

For example, instead of the ridges 123*a* on the pixel electrodes 121*a* shown in FIG. 4, the slits 123*b* may be formed thereon. In addition, the ridges 123*a* may be formed on the opposite electrode 121*b* instead of the slits 123*b*. In either case, an oblique electric field forms in the vicinity of the ridges 123*a* or slits 123*b* under applied voltage. The liquid crystal molecules in the vicinity (area A) of the member (123*a* or slit 123*b*) align to the electric field. In contrast, the alignment direction of the liquid crystal molecules away from the members (area B) is determined by the continuum of the liquid crystal after the alignment direction in the area A is determined. Therefore, even when the liquid crystal cell thus structured is used as the liquid crystal cell in the pixel array 2, similar effects to the embodiments are achieved.

Figure 16:
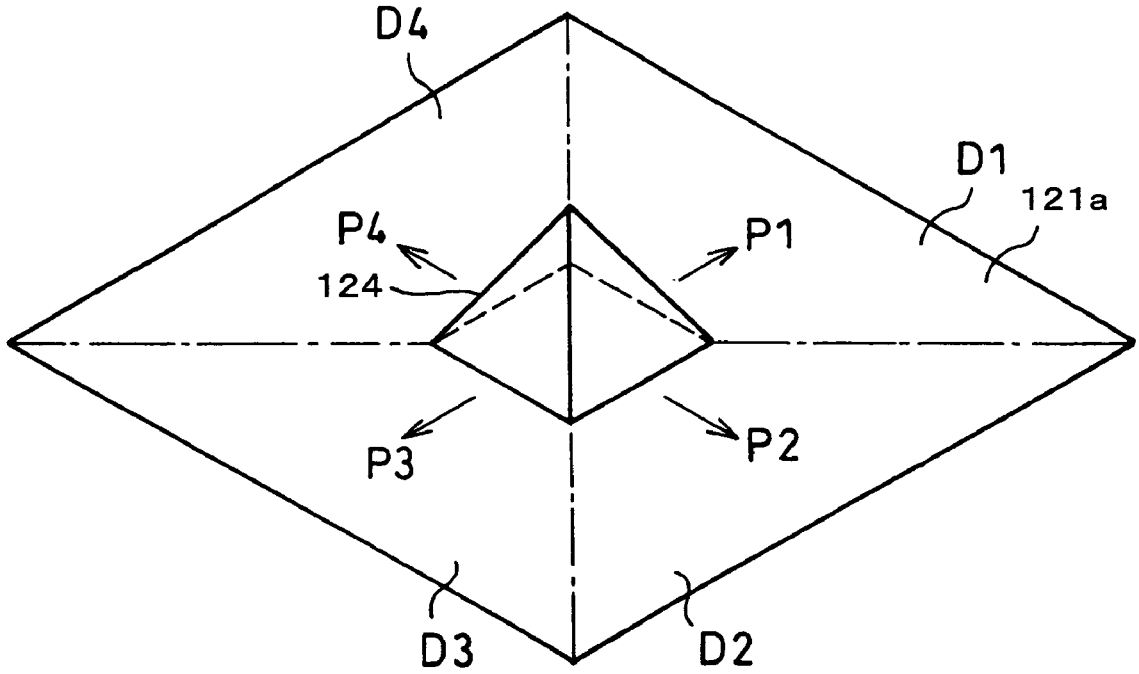
FIG. 16, depicting another structural example of the liquid crystal cell, is a perspective view illustrating a pixel electrode.

In another structure, the liquid crystal cell including a pixel electrode 121*a* shown in FIG. 16 has no ridge 123*a* or slit 123*b* as in FIG. 4. The pixel electrode 121*a* is provided with a quadrangular pyramid projection 124. Like the ridge 123*a*, the projection 124 can be made by applying a photosensitive resin onto the pixel electrode 121*a* which is then processed by photolithography.

In this structure, the liquid crystal molecules align vertical to the slopes in the vicinity of the projection 124. When a voltage is applied, the electric field near the projection 124 inclines parallel to the slopes of the projection 124. Therefore, when a voltage is applied, the in-plane component of the align angle of each liquid crystal molecule matches that of the normal of the closest slope (direction P1, P2, P3 or P4). Thus, the pixel area is divided into four domains D1 to D4 each with a different alignment direction of tilted molecules from the others.

The liquid crystal molecules of this structure also appear the darkest when they align substantially vertical. The contrast ratio is improved by: designating this state as a black display. However, if the grayscale level is changed from this state, the liquid crystal molecules need to determine both the alignment direction and the tilt angle. Therefore, in the following state, in other words, because the alignment orientation is already determined, most liquid crystal molecules in the pixels show slow response speed when compared with a state where it is sufficient to determine only the tilt angle. As a result, even when the liquid crystal cell thus structured is used as the liquid crystal cell in the pixel array 2, similar effects to the embodiments are achieved. The provision of one projection 124 for each pixel electrode 121*a* may fall short of sufficiently defining the alignment, causing the alignment instable in 40-inch or similarly large liquid crystal TVs because of the resultant size of each pixel which is as large as about 1 mm on each side, for example. Accordingly, it is preferable to provide a plurality of projections 124 on each pixel electrode 121*a* when the alignment might be insufficiently defined as in the this case.

Figure 17:
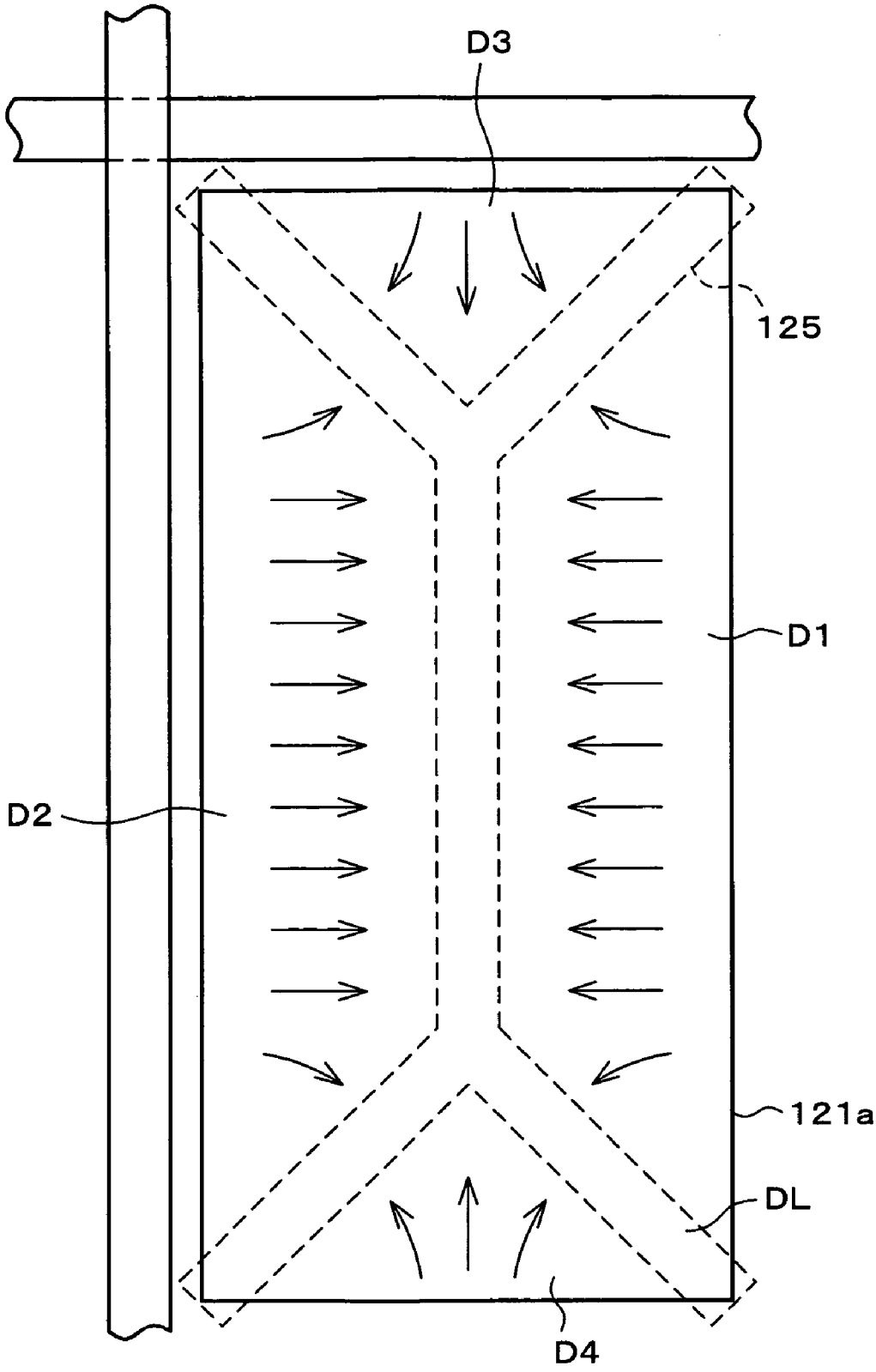
FIG. 17, depicting a further structural example of the liquid crystal cell, is a plan view illustrating a pixel electrode and its vicinity.

Further, for example, as shown in FIG. 17, the multidomain alignment is achieved also by providing an alignment control window 125 where no electrode is present on the opposite electrode 121*b* on the opposite substrate 111*b*. The window 125 is made up of two figure-Y-shaped slits symmetrically coupled in a up/down direction (in-plane parallel direction to any of the sides of the substantially rectangular pixel electrode 121*a*).

According to the arrangement, in the part of the surface of the opposite substrate 111*b* which is directly underneath the alignment control window 125, an applied voltage cannot generate an electric field which sufficiently causes the liquid crystal molecules to tilt. The liquid crystal molecules align vertical. In contrast, in the part of the surface of the opposite substrate 111*b* surrounding the alignment control window 125, an electric field develops which fans away from the alignment control window 125 as it gets closer to the opposite substrate 111*b*. The liquid crystal molecules tilt with their long axes aligning vertical to the electric field. The in-plane component of the alignment direction of the liquid crystal molecules is substantially vertical to the sides of the alignment control window 125 as indicated by arrows in the figure.

The liquid crystal molecules of this structure also appear the darkest when they align substantially vertical. The contrast ratio is improved by designating this state as a black display. However, if the grayscale level is to be changed from this state, the liquid crystal molecules need to determine both the alignment direction and the tilt angle. Therefore, in the following state, in other words, because the alignment orientation is already determined, most liquid crystal molecules in the pixels show slow response speed when compared with a state where it is sufficient to determine only the tilt angle. As a result, even when the liquid crystal cell thus structured is used as the liquid crystal cell in the pixel array 2, similar effects to the embodiments are achieved.

Figure 18:
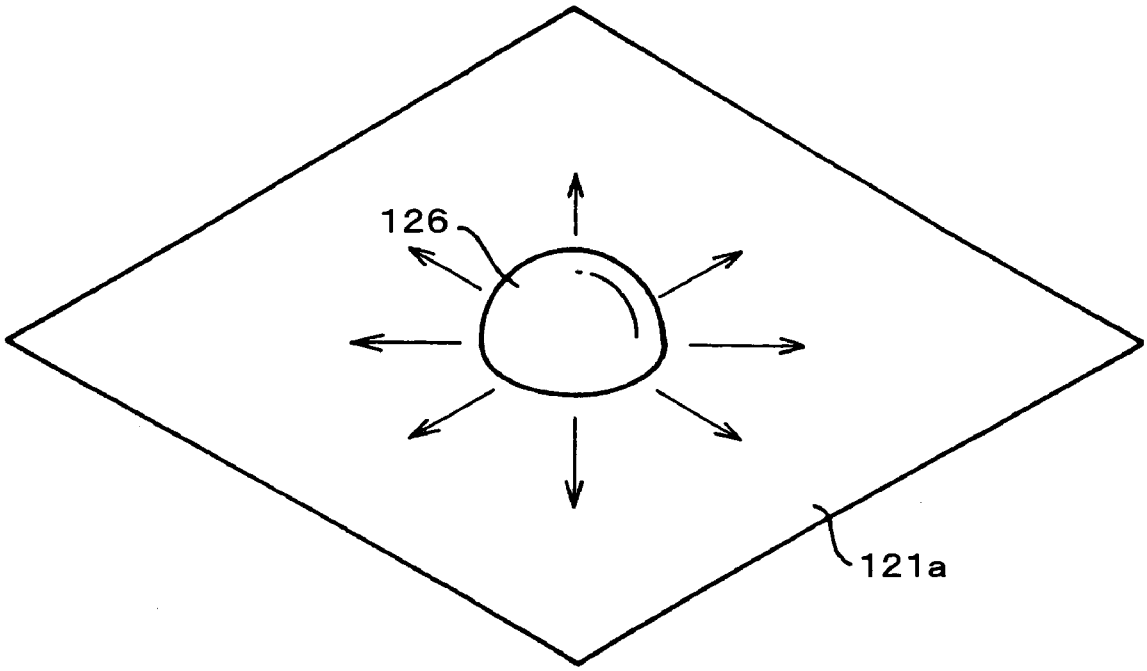
FIG. 18, depicting yet another structural example of the liquid crystal cell, is a perspective view illustrating a pixel electrode.
Figure 19:
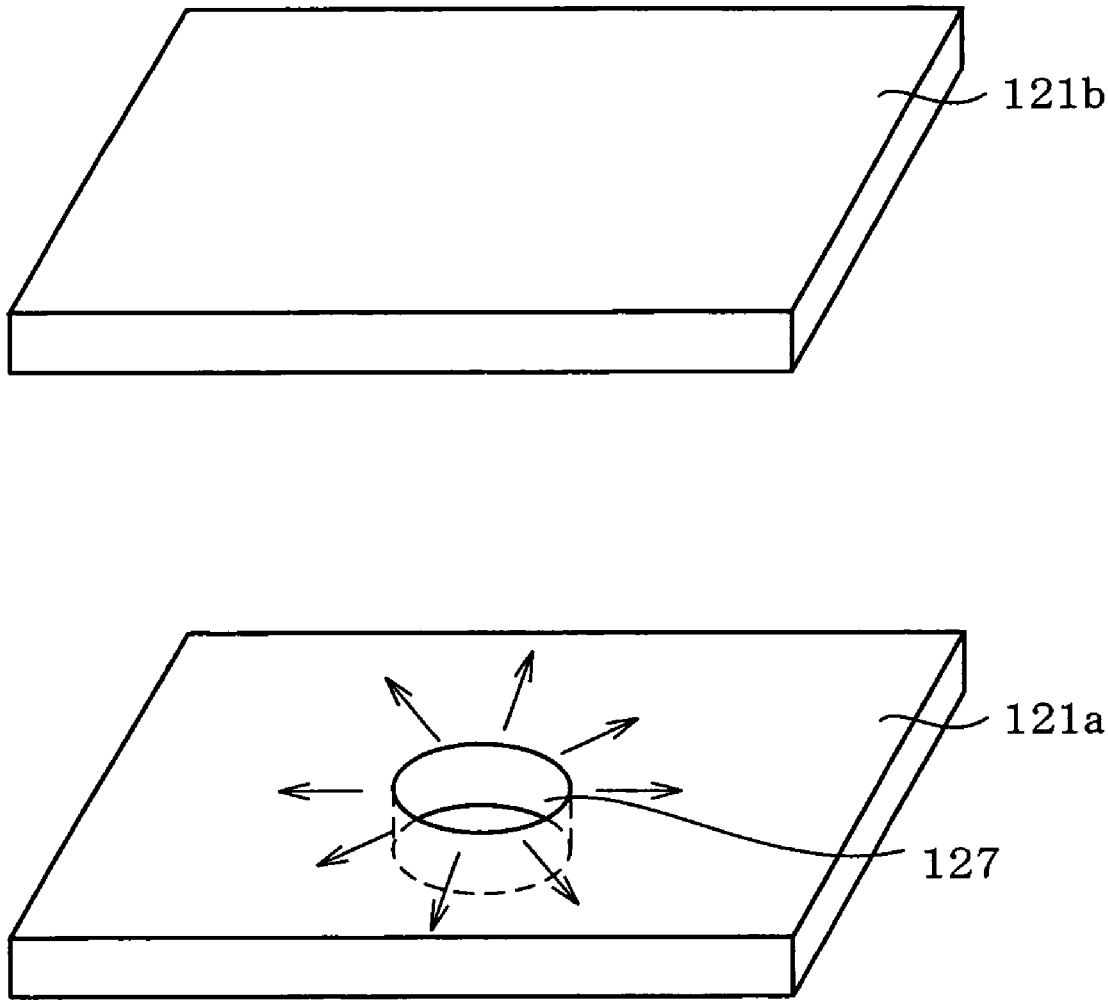
FIG. 19, depicting still another structural example of the liquid crystal cell, is a perspective view illustrating a pixel electrode and an opposite electrode.

The foregoing description has discussed the alignment direction being divided into four. As shown in FIG. 18 and FIG. 19, similar effects are achieved by the use of a liquid crystal cell 111 with radial alignment directions.

Specifically, in the structure shown in FIG. 18, there is provided a substantially hemispherical projection 126 in place of the projection 124 shown in FIG. 16. The liquid crystal molecules in the vicinity of the projection 126 again align vertical to the surface of the projection 126. Further, near the projection 126, an applied voltage generates an electric field inclined parallel to the surface of the projection 126. The liquid crystal molecules are likely to tilt radially in-plane from the projection 126 due to the electric field. The liquid crystal molecules in the liquid crystal cell 111 align radially. The projection 126 can be made by the same process as the projection 124. Like the projection 124, it is preferable to provide a plurality of projections 126 on each pixel electrode 121*a* when the alignment might be insufficiently defined.

The liquid crystal cell of this structure also appears the darkest when the liquid crystal molecules align substantially vertical. The contrast ratio is improved by designating this state as a black display. However, if the grayscale level is to be changed from this state, the liquid crystal molecules need to determine both the alignment direction and the tilt angle. Therefore, in the following state, in other words, because the alignment orientation is already determined, most liquid crystal molecules in the pixels show slow response speed when compared with a state where it is sufficient to determine only the tilt angle. As a result, even when the liquid crystal cell thus structured is used as the liquid crystal cell in the pixel array 2, similar effects to the embodiments are achieved.

Further, in the FIG. 19 structure, a circular slit 127, instead of the projection 124 in FIG. 16, is provided in the pixel electrode 121*a*. Accordingly, in the part of the surface of the pixel electrodes 121*a* directly above the slit 127, an applied voltage cannot generate an electric field which sufficiently causes the liquid crystal molecules to tilt. Therefore, the liquid crystal molecules align vertical on this part of the surface even under applied voltage. In contrast, in the part of the surface of the pixel electrode 121*a* in the vicinity of the'slit 127, an electric field develops which fans away from the slit 127 as it gets closer to the slit 127 in a thickness direction. The liquid crystal molecules away from the slit 127 tilt similarly with their long axes aligning vertically due to the continuum of the liquid crystal. Therefore, when a voltage is applied to the pixel electrode 121*a*, the liquid crystal molecules align so that the in-plane components of their alignment direction extend radially from the slit 127 as indicated by arrows in the figure. In other words, the molecules align symmetrically around the center of the slit 127. Since the tilting of the electric field changes with the voltage applied. The normal component of the alignment direction of the liquid crystal molecules to the substrate (tilt angle) is controllable through the apply voltage. The tilt angle off the normal to the substrate increases with an increase in the applied voltage. At high applied voltages, the liquid crystal molecules align substantially parallel tot the display screen and radially in-plane. In addition, it is preferable to provide a plurality of slits 127 on each pixel electrode 121*a* similarly to the projection 126 when the alignment might be insufficiently defined.

The liquid crystal cell of this structure also appears the darkest when the liquid crystal molecules align substantially vertical. The contrast ratio is improved by designating this state as a black display. However, if the grayscale level is to be changed from this state, the liquid crystal molecules need to determine both the alignment direction and the tilt angle. Therefore, in the following state, in other words, because the alignment orientation is already determined, most liquid crystal molecules in the pixels show slow response speed when compared with a state where it is sufficient to determine only the tilt angle. As a result, even when the liquid crystal cell thus structured is used as the liquid crystal cell in the pixel array 2, similar effects to the embodiments are achieved.

Further, in the pixel electrode 121*a*, the area where no electrode is provided (i.e., slit) and the area where an electrode is provided may be transpose. Specifically, in the pixel electrode 121*a* shown in FIG. 20, a plurality of slits 128 are provided so that their centers form a square lattice. Each solid-core section ("unit solid-core section") 129 has a substantially circular shape. The section 129 is surrounded substantially by four slits 128 whose centers are positioned at the four lattice points of one unit lattice. Each slit 128 has four quadrant arches as its edges and is shaped substantially like a star symbol with a 4-fold axis at the center. The pixel electrode 121*a* is also made of a conductive film (e.g., ITO film). For example, after providing a conductive film, the conductive film is removed so as form the star-shaped slits 128. A plurality of slits 128 is formed for each pixel electrode 121*a*. The solid-core sections 129 are made primarily from a single continuous conductive film.

The liquid crystal cell of this structure also appears the darkest when the liquid crystal molecules align substantially vertical. The contrast ratio is improved by designating this state as a black display. However, if the grayscale level is to be changed from this state, the liquid crystal molecules need to determine both the alignment direction and the tilt angle. Therefore, in the following state, in other words, because the alignment orientation is already determined, most liquid crystal molecules in the pixels show slow response speed when compared with a state where it is sufficient to determine only the tilt angle. As a result, even when the liquid crystal cell thus structured is used as the liquid crystal cell in the pixel array 2, similar effects to the embodiments are achieved.

The foregoing description has discussed the centers of the slits 128 form a square lattice as an example. The invention is not limited to this. The slits 128 may form a rectangular lattice or a lattice of another shape. The description has also discussed the slits 127 and the solid-core sections 129 being substantially circular as an example. The slits 127 and section 129 may be elliptical, rectangular, or of another shape.

In either structure, substantially similar effects are achieved with a liquid crystal cell in which the alignment direction of the liquid crystal molecules is determined by an electric field if the following conditions are met: The liquid crystal molecules vertically align in the absence of applied voltage; and a voltage applied to a pixel electrode generates an oblique electric field in the vicinity areas (edge areas) of the interface between those parts where the electrode is formed and those parts where no electrode is formed.

Figure 20:
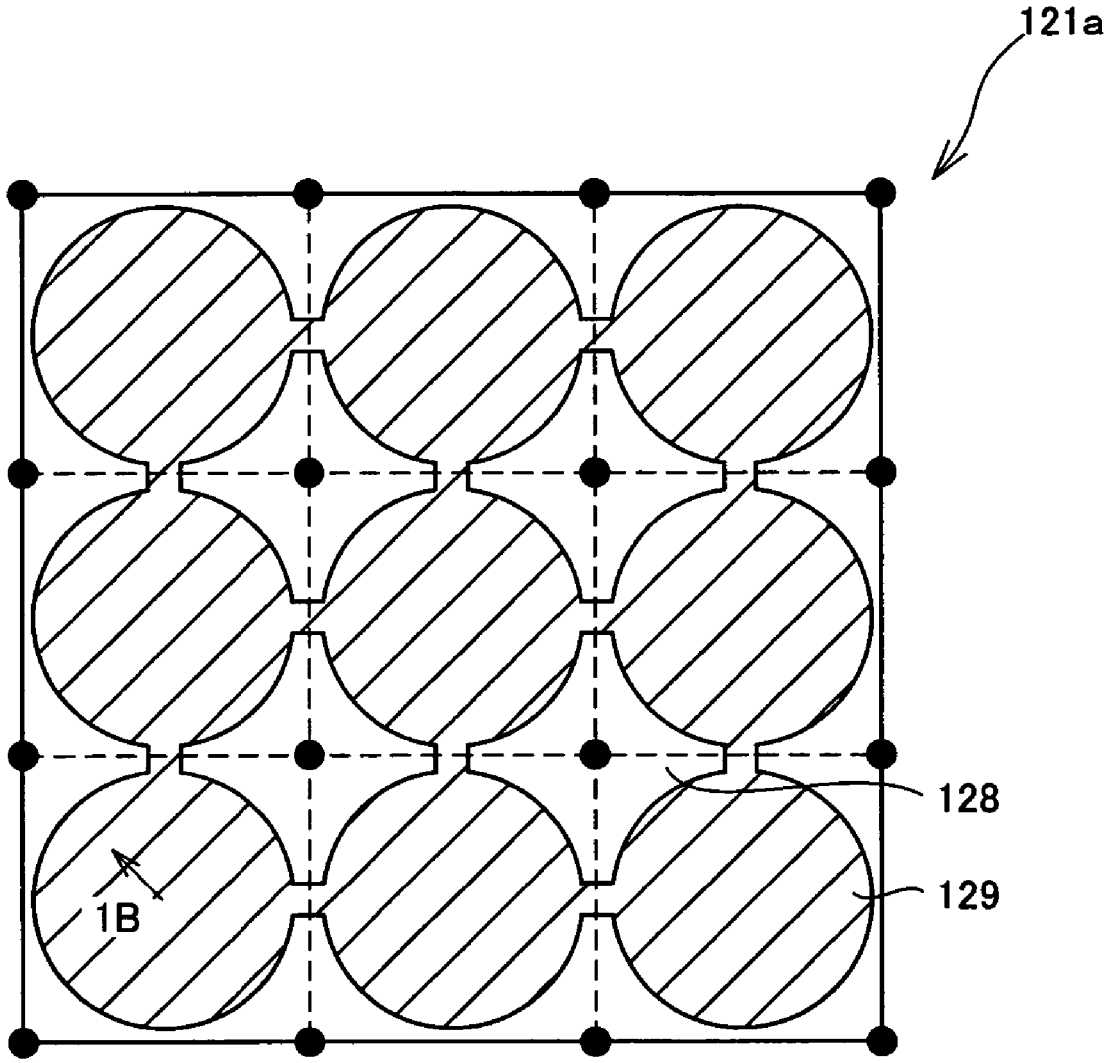
FIG. 20, depicting another structural example of the liquid crystal cell, is a plan view illustrating a pixel electrode.

Nevertheless, the image display 1 possesses better viewing angle characteristics if the centers of the slits 128 form a square lattice and the solid-core sections 129 are substantially circular as shown in FIG. 20, because the structure enables the alignment orientation of the liquid crystal molecules in the pixels PIX to be evenly dispersed.

In addition, the embodiments have assumed that the decoder section (11), the resolution converter section (12, 12*a*), the video filter section (13, 13*b*), and the motion-adaptive grayscale level converter section 21 are provided solely in the form of hardware as an example. This is not the only possibility. All or some of the members may be provided by a combination of computer programs realizing the aforementioned functions and hardware (computer) executing the programs. As an example, the members may be realized as a device driver or application program used when a computer connected to the pixel array (2) drives the pixel array or when the computer generates a video signal for the pixel array 2. The application programs may be, for example, those filtering outputs from another application (DVD player, etc.). In addition, when the members is realized as a built-in or peripheral conversion substrate for the image display, and the operation of the circuitry realizing the members can be altered by, for example, rewriting the firmware or other program, the software may be distributed by distributing computer-readable storage media containing the software or transferring the software over a channel, etc., or by similar means, so that the hardware can implement the software. The hardware thus operates as the members.

In these cases, provided that there is hardware prepared capable of achieving the aforementioned functions, the members of the embodiments can be realized merely by letting the hardware run the program.

To describe in more detail, the software is to be used to realize the functions, a CPU or other computing means made of hardware, etc. capable of executing the aforementioned functions executes program code contained in a ROM, RAM, or other storage device so as to control an input/output and other periphery circuits (not shown), thereby realizing the members of the embodiments.

In this case, the features can be realized by a combination of hardware implementing a part of a process and computing means executing program code for controlling the hardware or carrying out the rest of the process. Further, of the members, those described as hardware may be realized by a combination of hardware implementing a part of a process and computing means executing program code for controlling the hardware or carrying out the rest of the process. The computing means may be singly. Otherwise, a plurality of computing means may be connected through internal buses and various channels for collaborative execution of program code.

The program code per se which is directly executable by the computing means or a program as data capable of generating program code by decompression or another process (detailed later) may be distributed for execution by the computing means, by recording the computer program (program code or the data) in a storage medium and distributing the storage medium or transferring the program by communications means via wired or wireless channels.

For transfer over a channel, transmission media making up a channel propagate a series of signals indicative of programs to each other so as to transfer the program via the channel. In addition, when transferring a series of signals, the transmitter may superimpose the series of signals indicative of programs onto a carrier wave by modulating the carrier wave based on the series of signals. In this case, the series of signals is reproduced by a receiver demodulating the carrier wave. In contrast, when transferring the series of signals, the transmitter may transfer by dividing the series of signals as a series of digital data into packets. In this case, the receiver reproduces the series of signals by coupling received packet groups. In addition, when the transmitter is to transmit the series of signals, the series of signals may be multiplexed with another series of signals by time division/frequency divide/code divide, etc. In this case, the receiver reproduces the individual series of signals by extracting them from the multiplexed series of signals. In either case, similar effects are achieved provided that the program can be transferred via a channel.

The storage medium used for the distribution of programs is preferably removable. The storage medium is however not necessarily removable after the distribution of the programs. In addition, the storage medium may be either rewriteable (writeable) or non-rewriteable (non-writeable), either volatile or involatile, and of any recording method and of any shape so long as the medium can store the programs. Examples of such a storage medium include tapes, such as magnetism tapes and cassette tapes; magnetic disks, such as a floppy (registered trademark) disk and a hard disk; and discs, such as a magneto-optical discs (MO), a CD-ROM, a mini disc (MD), and a digital video disc (DVD). In addition, the storage medium may be a card, such as an IC card or an optical card; or a semiconductor memory, such as a mask ROM, an EPROM, an EEPROM, or a flash ROM. The medium may be a memory integrated into a CPU or other computing means.

The program code may be for instructing the computing means to implement all the procedures of the process, or if there is already a basic program capable of executing a part or the entirety of the process by recalling by a predetermined procedure (e.g., operating system or library), may replace some or all of the whole procedures by code, pointer, etc. instructing the computing means to recall the basic program.

In addition, the format of recording the program may be recorded in the storage medium may be, for example, a recording format which the computing means can access and execute like a state arranged in real memory, a recording format before arranging in real memory and after installed in a local storage medium (e.g., real memory, hard disk, etc.) which the computing means can always access, or a recording format before installing in a local storage medium from a network, a mobile storage medium, etc. In addition, the programs are not limited to compiled object code. They may be stored as source code or intermediate code generated in the way in interpretation and compilation. In either case, similar effects are achieved in whichever format the programs are recorded in the storage medium, so long as the format can be converted to a format executable by the computing means through decompression of compressed information, decoding of encoded information, interpretation, compilation, link, or arrangement in real memory, or another process, or a combination of these processes.

As described in the foregoing, the driver device for a liquid crystal display in accordance with an aspect of the present invention (e.g., motion-adaptive grayscale level converter section 21) includes a liquid crystal cell of normally black and vertically aligned mode as a display element (e.g., pixel array 2). The driver device includes: determine means (e.g., motion-adaptive grayscale level converter section 21) for determining whether a pixel is in a moving image area; and grayscale level conversion means (e.g., motion-adaptive grayscale level converter section 21) for, if the pixel is determined to be in the moving image area, changing grayscale level data representing a grayscale level of the pixel so that there is no darker grayscale level than a predetermined first grayscale level. The driver device for the liquid crystal display may be configured by hardware or by a computer running a computer program.

In a liquid crystal cell of vertically aligned mode, liquid crystal molecules align substantially vertically to a substrate in the absence of applied voltage. In such a liquid crystal cell, voltage is applied to pixel electrodes to generate an electric field oblique to the substrate surface. The electric field causes the tilting of the liquid crystal molecules.

When the liquid crystal molecules substantially vertically align, however, the alignment orientation (in-plane component of the alignment direction as projected on the substrate) is yet to be definite. When the liquid crystal molecules which is to tilt from this state, both the alignment orientation and the tilt angle (angle between the normal to the substrate and the alignment direction) become definite once the applied voltage increases. In contrast, those liquid crystal molecules of which the alignment orientation is already definite, do not need to determine alignment orientation. They only have to determine the tilt angle in accordance with apply voltage.

Therefore, the liquid crystal cell tends to show a far slower response speed when the grayscale level is changed from a grayscale level near black (a state where there are still many liquid crystal molecules of which the alignment orientation is yet to be definite in the pixel) than when the grayscale level is changed from a middle level (a state where almost all the liquid crystal molecules in the pixel only need to decide the tilt angle).

In these circumstances, if the voltage applied to the pixel is always increased when displaying black so as to prevent the occurrence of a state where there are still many liquid crystal molecules of which the alignment orientation is yet to be definite, the contrast ratio decreases even in a case where no quick response speed is needed, like in a case where a still image is displayed.

In contrast, according to the arrangement, for example, the determine means determines whether the pixel is in a moving image area on the basis of an input video signal or information from a member processing the input video signal. If the pixel is determined to be in a moving image area, the grayscale level conversion means changes the grayscale level data representing the grayscale level of the pixel so that there is no darker grayscale level than the first grayscale level. Therefore, image quality degradation due to insufficient response when displaying a moving image can be eased while maintaining the contrast ratio achieved for a still image display.

The member may be a decoder section, a resolution converter section, or a video filter section.

In addition to the arrangement, the determine means may determine whether or not the pixel is in the moving image area according to whether or not an intermediate region including the pixel evenly contains more than a threshold number of minimal regions of a moving image. The intermediate region is made up of multiple minimal regions, video in each frame being divided into the minimal regions.

If the determination as to a moving image is made for every minimal movie region and if a grayscale level conversion is done for every minimal movie region, minimal regions with different contrasts are displayed tangled. Block separation (block-like uneven luminance) may possibly become visible, which could cerate an unnatural video display. In addition, regarding relatively still areas like the background around a moving area of a moving image observation object, insufficient response cannot be improved when the minimal regions included in the area are dark.

In contrast, according to the arrangement, the intermediate region are made up of multiple minimal regions, and it is decided whether the pixel is in the moving image area according to whether or not an intermediate region including the pixel evenly contains more than a threshold number of minimal regions of a moving image.

Therefore, the grayscale level conversion can be done on the moving areas of a moving image observation object and the background around its periphery too. This limits occurrence of insufficient response in an area with the slowest response with more natural grayscale level display. In addition, even when the minimal regions in the background area are displayed dark, insufficient response is addressed.

In addition to the arrangement, a video signal by which the grayscale level data representing grayscale levels of pixels is identified may be expressed by a combination of still image data and vector data generated based on comparison of video in each frame with video in another frame; and the determine means may, if the minimal region includes a part expressed by vector data, determine that the minimal region is that of the moving image. The video signal may be for example, a video signal encoded in MPEG1 (Moving Picture Expert Group 1), MPEG2 (Moving Picture Expert Group 2), or other standards.

According to the arrangement, it is decided whether a minimal region is a minimal region of a moving image according to whether or not a minimal region includes a part expressed by vector data. The vector data and the still image data are both carried on the video signal. The decision as to whether the data is vector data or still image data is always done in a process of identifying grayscale level data representing the grayscale level of the pixel (e.g., decode processing) based on the video signal.

Therefore, part of a decision making process which is essential to the process of identifying grayscale level data representing the grayscale level of the pixel based on the video signal may be used as part of the process of determining whether the minimal regions are those of a moving image, so as to determine whether to perform a grayscale level conversion. This reduces the necessary computing and circuit size over cases where the decisions are made separately.

Similarly, in addition to the arrangement, a video signal by which the grayscale level data representing grayscale levels of pixels is identified may carry encoded data for the minimal regions making up the video in each frame; the encoded data for the minimal regions may be encoded by a first encoding method suitable for moving images or a second encoding method different from the first encoding method; and the determine means may determine whether or not the minimal regions are those of the moving image according to whether or not the encoded data for the minimal regions is encoded by the first encoding method. The video signal may be, for example, a video signal encoded in MPEG1 (Moving Picture Expert Group 1), MPEG2 (Moving Picture Expert Group 2), or other standards.

According to the arrangement, it is decided whether a minimal region is a minimal region of a moving image according to whether or not the data derived by encoding a minimal region is encoded by a first encoding method. The decision making process is a process that is always done in the video signal decoding process. Therefore, part of the decoding process can be used also as part of the process of determining whether the minimal regions are those of a moving image, so as to determine whether to perform a grayscale level conversion. This reduces the necessary computing and circuit size over cases where the decisions are made separately.

In addition to the arrangement, the determine means may receive information indicating whether the minimal regions are those of the moving image from video processing means (e.g., resolution converter section 12*a* or video filter section 13*b*) for video-processing a video signal by which the grayscale level data representing grayscale levels of pixels is identified, so as to determine whether or not the intermediate region including the pixel evenly contains more than a threshold number of minimal regions of the moving image based on the information; and the video processing means may determine whether or not the minimal regions are those of the moving image based on the video signal by which the grayscale level data representing grayscale levels of pixels is identified, for the video processing in accordance with a determination. The video processing is, for example, resolution conversion or video filtering.

According to the arrangement, it is determined whether the intermediate region including the pixel evenly contains more than a threshold number of minimal regions of the moving image based on the information from the video processing means. Therefore, part of the process, done in the video processing means, of determining whether the minimal regions are those of a moving image can be also used as part of the process determining whether the minimal regions are those of a moving image, so as to determine whether to perform a grayscale level conversion. This reduces the necessary computing and circuit size over cases where the decisions are made separately.

In addition to the arrangement, the grayscale level conversion means may, if the pixel is determined to be in the moving image area, replace grayscale level data representing a darker grayscale level than the first grayscale level with grayscale level data representing the first grayscale level.

According to the arrangement, the grayscale level data representing a darker grayscale level than the first grayscale level is replaced by grayscale level data representing the first grayscale level. Therefore, the grayscale level conversion can be performed by relatively simple computing of the compare and replace process so that there is no darker grayscale level than the first grayscale level.

In addition to the arrangement, the grayscale level conversion means may, if the pixel is determined to be in the moving image area, convert the grayscale level data to converted grayscale level data by a linear expression related to the grayscale level data.

According to the arrangement, the grayscale level data representing a darker grayscale level than the first grayscale level is converted to grayscale level data containing no darker grayscale level than the first grayscale level by the linear expression. Therefore, the ratio of the grayscale level represented by the grayscale level data prior to the conversion and the grayscale level represented by the grayscale level data after the conversion can be retained constant at around the first grayscale level. Image quality degradation due to a change in the ratio can be eased.

In addition to the arrangement, the grayscale level conversion means may, if the pixel is determined to be in the moving image area, convert grayscale level data representing a grayscale level less than or equal to a predetermined second grayscale level to converted grayscale level data by a linear expression related to the grayscale level data to be converted, the second grayscale level being a brighter grayscale level than the first grayscale level.

According to the arrangement, the ratio of the grayscale level represented by the grayscale level data prior to the conversion and the grayscale level represented by the grayscale level data after the conversion can be retained constant at around the first grayscale level. In addition, the second grayscale level can be specified so that the grayscale level conversion by the linear expression does not cause large rounding errors. Image quality degradation due to rounding errors can be eased without adding to the required computing or circuit size to restrict rounding error occurrences. Further, changes in the ratio at around the second grayscale level can be limited when compared with changes in the ratio at around the first grayscale level in the arrangement where the first grayscale level replaces. Therefore, the resultant driver device for a liquid crystal display is well-balanced in necessary computing, circuit size, and image quality.

In addition to the arrangement, the predetermined first grayscale level indicates luminance higher than 0%, but not exceeding 1%, of white luminance. According to the arrangement, image quality degradation due to insufficient response can be eased while retaining the contrast ratio in the moving image area within a tolerable range.

The driver device for a liquid crystal display (e.g., motion-adaptive grayscale level converter section 21) in accordance with another aspect of the present invention, as described in the foregoing, is a driver device for a liquid crystal display including a liquid crystal cell of normally black and vertically aligned mode as a display element (e.g., pixel array 2). The device, if an image includes a moving image area, changes a signal value for a pixel, in the moving image area, which is instructed to produce a display at a darker grayscale level than a predetermined first grayscale level to a value instructing a brighter grayscale display than in a case where a part of the image which is in the moving image area is displayed as a still image.

According to the arrangement, the signal value for the pixel, in the moving image area, which is instructed to produce a display at a darker grayscale level than a predetermined first grayscale level is changed to a value instructing a brighter grayscale display than in a case when displayed as a still image. Therefore, image quality degradation due to insufficient response when displaying a moving image is eased while maintaining the contrast ratio achieved for a still image display although a liquid crystal cell of normally black and vertically aligned mode having the following properties, in other words, a liquid crystal cell of normally black and vertically aligned mode which tends to have improved viewing angle characteristics and contrast ratio, but which tends to show far slower response speed when the grayscale level is changed from a near-black grayscale level, is used as a display element.

A computer program in accordance with the present invention is a computer program causing a computer to operate as: determine means for determining whether a pixel is in a moving image area; and grayscale level conversion means, the computer being capable of generating a video signal for a liquid crystal display including a liquid crystal cell of normally black and vertically aligned mode as a display element, grayscale level data representing a grayscale level of the pixel in the liquid crystal cell being identified according to the video signal, the grayscale level conversion means, if the pixel is determined to be in the moving image area, changing the grayscale level data representing the grayscale level of the pixel so that there is no darker grayscale level than a predetermined first grayscale level. Another computer program in accordance with the present invention is a computer program causing a computer to execute a process, the computer being capable of controlling a signal value for each pixel in a liquid crystal display including a liquid crystal cell of normally black and vertically aligned mode as a display element, in the process, the computer, if an image includes a moving image area, changing a signal value for a pixel, in the moving image area, which is instructed to produce a display at a darker grayscale level than a predetermined first grayscale level to a value instructing a brighter grayscale display than in a case where a part of the image which is in the moving image area is displayed as a still image. In addition, the storage medium in accordance with the present invention contains one of these computer programs.

As either of these computer programs is executed by a computer, the computer operates as a driver device for a driver device for a liquid crystal display. Therefore, similarly to the driver device for a display, image quality degradation due to insufficient response when displaying a moving image can be eased while maintaining the contrast ratio achieved for a still image display.

In addition, the liquid crystal display in accordance with the present invention (e.g., image displays 1 to 1*b*) includes: one of the foregoing driver devices for a liquid crystal display; and a display element including a liquid crystal cell of normally black and vertically aligned mode driven by the driver device for the liquid crystal display. Therefore, similarly to a driver device for the liquid crystal display, image quality degradation due to insufficient response when displaying a moving image can be eased while maintaining the contrast ratio achieved for a still image display.

In addition to the arrangement, the display may be an image receiver for television broadcast. In addition to the arrangement, the display may be a liquid crystal monitor. Since the liquid crystal display can ease image quality degradation due to insufficient response when displaying a moving image while maintaining the contrast ratio achieved for a still image display, these image receiver for television broadcast and liquid crystal are especially preferably used as similar devices.

According to the present invention, as described in the foregoing, when a video signal is to be generated for a liquid crystal cell of normally black and vertically aligned mode as a display element, if a pixel is determined to be in a moving image area, the signal value for the pixel, in the moving image area, which is instructed to produce a display at a darker grayscale level than a predetermined first grayscale level is changed to a value instructing a brighter grayscale display than in a case when displayed as a still image by, for example, changing grayscale level data representing the grayscale level of the pixel so that there is no darker grayscale level than a predetermined first grayscale level. Therefore, although a liquid crystal cell of normally black and vertically aligned mode having the following properties, in other words, a liquid crystal cell of normally black and vertically aligned mode which tends to have improved viewing angle characteristics and contrast ratio, but which tends to show far slower response speed when the grayscale level is changed from a near-black grayscale level, is used as a display element, image quality degradation due to insufficient response when displaying a moving image can be eased while maintaining the contrast ratio achieved for a still image display. The invention is preferably used as various liquid crystal displays including image receivers for television broadcast and liquid crystal monitors or to drive them and generate video signals for the driving.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A driver device for a liquid crystal display including a liquid crystal cell of normally black and vertically aligned mode as a display element, the device comprising:

determine means for determining whether a pixel is in a moving image area; and grayscale level conversion means for, if the pixel is determined to be in the moving image area, changing grayscale level data representing a grayscale level of the pixel so that there is no darker grayscale level than a threshold grayscale level greater than zero.

2. The driver device for a liquid crystal display of claim 1, wherein the determine means determines whether or not the pixel is in the moving image area according to whether or not an intermediate region including the pixel evenly contains more than a threshold number of minimal regions of a moving image, the intermediate region being made up of multiple minimal regions, video in each frame being divided into the minimal regions.

3. The driver device for a liquid crystal display of claim 2, wherein:

a video signal by which the grayscale level data representing grayscale levels of pixels is identified is expressed by a combination of still image data and vector data generated based on comparison of video in each frame with video in another frame; and the determine means, if the minimal region includes a part expressed by vector data, determines that the minimal region is that of the moving image.

4. The driver device for a liquid crystal display of claim 2, wherein:

a video signal by which the grayscale level data representing grayscale levels of pixels is identified carries encoded data for the minimal regions making up the video in each frame;

the encoded data for the minimal regions is encoded by a first encoding method suitable for moving images or a second encoding method different from the first encoding method; and the determine means determines whether or not the minimal region is that of the moving image according to whether or not the encoded data for the minimal regions is encoded by the first encoding method.

5. The driver device for a liquid crystal display of claim 2, wherein:

the determine means receives information indicating whether the minimal regions are those of the moving image from video processing means for video-processing a video signal by which the grayscale level data representing grayscale levels of pixels is identified, so as to determine whether or not the intermediate region including the pixel evenly contains more than a threshold number of minimal regions of the moving image based on the information; and the video processing means determines whether or not the minimal regions are those of the moving image based on the video signal by which the grayscale level data representing grayscale levels of pixels is identified, for the video processing in accordance with a determination.

6. The driver device for a liquid crystal display of claim 1, wherein the grayscale level conversion means, if the pixel is determined to be in the moving image area, replaces grayscale level data representing a darker grayscale level than the first grayscale level with grayscale level data representing a threshold grayscale level.

7. The driver device for a liquid crystal display of claim 1, wherein the grayscale level conversion means, if the pixel is determined to be in the moving image area, converts the grayscale level data to converted grayscale level data by a linear expression related to the grayscale level data.

8. The driver device for a liquid crystal display of claim 1, wherein the grayscale level conversion means, if the pixel is determined to be in the moving image area, converts grayscale level data representing a grayscale level less than or equal to a second grayscale level to converted grayscale level data by a linear expression related to the grayscale level data to be converted, the second grayscale level being a brighter grayscale level than the first grayscale level.

9. The driver device for a liquid crystal display of claim 1, wherein the first grayscale level indicates luminance higher than 0%, but not exceeding 1%, of white luminance.

10. A computer-readable storage medium containing a computer program causing a computer to operate as: determine means for determining whether a pixel is in a moving image area; and grayscale level conversion means, the computer being capable of generating a video signal for a liquid crystal display including a liquid crystal cell of normally black and vertically aligned mode as a display element, grayscale level data representing a grayscale level of the pixel in the liquid crystal cell being identified according to the video signal, the grayscale level conversion means, if the pixel is determined to be in the moving image area, changing the grayscale level data representing the grayscale level of the pixel so that there is no darker grayscale level than a threshold grayscale level greater than zero.

11. A liquid crystal display, comprising:

a driver device for the liquid crystal display; and a display element including a liquid crystal cell of normally black and vertically aligned mode driven by the driver device for the liquid crystal display, the driver device for the liquid crystal display including: determine means for determining whether a pixel is in a moving image area; and grayscale level conversion means for, if the pixel is determined to be in the moving image area, changing grayscale level data representing a grayscale level of the pixel so that there is no darker grayscale level than a threshold grayscale level greater than zero.

12. The liquid crystal display of claim 11, wherein the display is an image receiver for television broadcast.

13. The liquid crystal display of claim 11, wherein the display is a liquid crystal monitor.

* * * * *